US008752651B2

(12) United States Patent
Randall et al.

(10) Patent No.: US 8,752,651 B2
(45) Date of Patent: Jun. 17, 2014

(54) DOWNHOLE HYDRAULIC JETTING ASSEMBLY, AND METHOD FOR STIMULATING A PRODUCTION WELLBORE

(76) Inventors: Bruce L. Randall, Tulsa, OK (US); Michael J. Brogdin, Amarillo, TX (US)

( * ) Notice: Subject to any disclaimer, the term of this patent is extended or adjusted under 35 U.S.C. 154(b) by 539 days.

(21) Appl. No.: 13/033,587

(22) Filed: Feb. 23, 2011

(65) Prior Publication Data

US 2011/0203847 A1 Aug. 25, 2011

Related U.S. Application Data

(60) Provisional application No. 61/308,060, filed on Feb. 25, 2010.

(51) Int. Cl.
*E21B 7/08* (2006.01)
*E21B 43/114* (2006.01)

(52) U.S. Cl.
USPC ..... 175/67; 175/62; 166/298; 166/117.6

(58) Field of Classification Search
USPC ..... 175/61, 62, 67, 74; 166/298, 55, 117.6, 166/117.5
See application file for complete search history.

(56) References Cited

U.S. PATENT DOCUMENTS

| | | | | |
|---|---|---|---|---|
| 4,524,833 | A * | 6/1985 | Hilts et al. | 166/381 |
| 5,413,184 | A | 5/1995 | Landers | |
| 5,853,056 | A | 12/1998 | Landers | |
| 6,125,949 | A | 10/2000 | Landers | |
| 6,260,623 | B1 * | 7/2001 | Schick | 166/313 |
| 6,263,984 | B1 | 7/2001 | Buckman, Sr. | |
| 6,378,629 | B1 | 4/2002 | Baird | |
| 6,412,578 | B1 | 7/2002 | Baird | |
| 6,419,020 | B1 | 7/2002 | Spingath | |
| 6,530,439 | B2 | 3/2003 | Mazorow | |
| 6,550,553 | B2 | 4/2003 | Baird | |
| 6,578,636 | B2 | 6/2003 | Mazorow et al. | |
| 6,668,948 | B2 | 12/2003 | Buckman, Sr. et al. | |
| 6,889,781 | B2 | 5/2005 | Mazorow | |
| 6,915,853 | B2 | 7/2005 | Bakke et al. | |
| 6,964,303 | B2 | 11/2005 | Mazorow et al. | |
| 6,971,457 | B2 | 12/2005 | Baird | |

(Continued)

OTHER PUBLICATIONS

Office Action from CIPO dated Mar. 21, 2013 in related Canadian patent application (2 pages).

(Continued)

*Primary Examiner* — David Andrews
(74) *Attorney, Agent, or Firm* — Baker Donelson; Peter L. Brewer

(57) ABSTRACT

A method for forming lateral boreholes from an existing wellbore is provided. The method comprises providing a downhole tool assembly having a whipstock with a curved face. The whipstock is run into the wellbore in a collapsed position. A force is applied to the assembly to cause the whipstock to rotate into an operating position. In this position, the curved face of the whipstock forms a bend-radius that allows a jetting hose to bend across the entire inner diameter of the production casing. A jetting hose is run into the wellbore and along the curved face of the whipstock. The jetting hose is then directed through a window in the production casing. Hydraulic fluid is injected through the hose to create a lateral borehole extending many feet outwardly into a subsurface formation. A downhole jetting assembly for forming lateral boreholes is also provided.

38 Claims, 21 Drawing Sheets

(56) References Cited

U.S. PATENT DOCUMENTS

| | | | | |
|---|---|---|---|---|
| 7,357,182 | B2 * | 4/2008 | Hunt et al. | 166/298 |
| 7,422,059 | B2 | 9/2008 | Jelsma | |
| 7,441,595 | B2 | 10/2008 | Jelsma | |
| 7,455,127 | B2 | 11/2008 | Schick | |
| 7,669,697 | B2 | 3/2010 | Brunet et al. | |
| 7,686,101 | B2 | 3/2010 | Belew et al. | |
| 7,699,107 | B2 | 4/2010 | Butler et al. | |
| 8,074,744 | B2 | 12/2011 | Watson | |
| 8,196,680 | B2 | 6/2012 | Buckman, Sr. et al. | |
| 2009/0107678 | A1 | 4/2009 | Buckman, Sr. | |
| 2010/0243266 | A1 | 9/2010 | Soby et al. | |

OTHER PUBLICATIONS

Office Action from CIPO dated Dec. 4, 2012 in related Canadian patent application (2 pages).

Summers, D. A., Corwine, J., Chen, L., A Comparison of Methods Available for the Determination of Surface Energy, 12th Symposium on Rock Mechanics, University of Missouri-Rolla (Nov. 1970) http://www.rockmech.mst.edu/documents/ paper6.pdf.

Joshi, S. D., A Review of Horizontal Well and Drainhole Technology, Society of Petroleum Engineers No. 16,868, pp. 339-355; Originally presented at the 62nd Annual Technical Conference and Exhibition of the SPE, Dallas, Texas (Sep. 27-30, 1987).

Olsen, J. H, Abrasive Jet Mechanics, The Fabricator Magazine (Mar. 2005) http://www.omax.com/images/files /abrasivejet%20mechanics.pdf.

Kojic, M., Cheatham, J.B., Jr., Analysis of the Influence of Fluid Flow on the Plasticity of Porous Rock Under an Axially Symmetric Punch, Society of Petroleum Engineers No. 4243; Society of Petroleum Engineer's Journal (Jun. 1974); Originally presented at SPE-AIME Sixth Conference on Drilling and Rock Mechanics, Austin, Texas (Jan. 22-23, 1973).

Summers, D.A., Barker, C.R., Selberg, B.P., Can Nozzle Design Be Effectively Improved for Drilling Purposes, Energy Technological Conference and Exhibition, ASME, Houston, Texas (Nov. 5-8, 1978) http://www.rockmech.mst.edu/documents/paper51.pdf.

*Carl Landers and Landers Horizontal Drill Inc* v *Sideways LLC*., United States Court of Appeals for the Federal Circuit, 04-1510, -1538 (Decided: Jul. 27, 2005).

Carrell George Gibbons Topical Report, Lateral Drilling and Completion Technologies for Shallow-Shelf Carbonates of the Red River and Ratcliffe Formations, Williston Basin (Jul. 31, 1997). Work performed under Cooperative Agreement No. DE-FC22-94BC14984-16 Improved Recovery Demonstration for Williston Basin Carbonates, prepared for U.S. Department of Energy, National Petroleum Technology Office, Tulsa, Oklahoma, prepared by Luff Exploration Company, Denver, Colorado.

Dickinson, W., Dickinson, R.W., Pesevento, M.J., Data Acquisition Analysis and Control While Drilling With Horizontal Water Jet Drilling Systems, Society of Petroleum Engineers No. 90-127: Joint SPE/CIM International Technical Meeting, Calgary, Canada (Jun. 10-13, 1990).

Momber, A.W., Deformation and Fracture of Rocks Due to High Speed Liquid Impingement, International Journal of Fracture, #130, pp. 683-704, Kluwer Academic Publishers, Netherlands (Aug. 2004).

Tziallas, G.P., Tsiambaos, G., Saroglou, H., Determination of Rock Strength and Deformability of Intact Rocks, EJGE vol. 14, Bund. G, Paper #2008-0960; 12 pages (2009) http://www.ejge.com/2009/Ppr0960/Abs0960.htm.

Summers, D. A., Lehnhoff, T. F., Weakly, L.A., Development of a Water Jet Drilling System and Preliminary Applications of its Performance in a Stress Situation Underground, 4th International Symposium on Jet Cutting Technology, Canterbury, England (Apr. 1978) http://www.rockmech.mst.edu/ documents/paper52.pdf.

Summers, D. A. Disintegration of Rock by High Pressure Jets, University of Leeds, Department of Applied Mineral Sciences, Ph.D. Dissertation (May 1968).

Katz, O., Reches, Z., Roegiers, J.C., Evaluation of Mechanical Rock Properties Using a Schmidt Hammer, International Journal of Rock Mechanics and Mining Science, vol. 37, pp. 723-728 (2000) http://earthquakes.ou.edu/reches/Publications/ Schmidt.htm.

Summers, D.A., Feasibility of Fluid Jet Based Drilling Methods for Drilling Through Unstable Formations, 2002 SPE International Thermal Operations and Heavy Oil Symposium and International Horizontal Well Technology Conference, Calgary, Alberta, Canada (Nov. 4-7, 2002).

Maurer, W.C., Heilhecker, J.K., Love, W.W., High Pressure Drilling, Journal of Petroleum Technology, pp. 851-859 (Jul. 1973).

Dickinson, W., Dickinson, R.W., Horizontal Radial Drilling System, Society of Petroleum Engineers No. 13,949; California Regional Meeting, Bakersfield, California (Mar. 27-29, 1985).

Maurer, W.C., Heilhecker, J.K., Hydraulic Jet Drilling, Society of Petroleum Engineers No. 2,434 (1969).

Pekarek, J.L., Lowe, D.K., Huitt, J.L., Hydraulic Jetting Some Theoretical and Experimental Results, Society of Petroleum Engineers No. 421: Society of Petroleum Engineers Journal, pp. 101-112 (Jun. 1963). Originally presented at 37th Annual Fall Meeting of SPE, Los Angeles, California (Oct. 7-10, 1962).

Kovacevic, R., Hydraulic Process Parameters. Southern Methodist University's Bobby B. Lyle School of Engineering—Website Publication; (undated) http://lyle.smu.edu/rcam/research/waterjet/ProcessParameter/Hydraulicprocessparameters.pdf.

Summers, D.A., Clark, G.B., Haas, C.J., Brown, J.W., HyperVelocity Impact on Rock, AIME's Eleventh Symposium on Rock Mechanics, Berkeley, California; Part VI—Chapter 32 (Jun. 1969) http://www.rockmech.mst.edu/documents /paper5.pdf.

Pittman, F.C.,Harriman, D.W., St. John, J.C., Investigation of Abrasive Laden Fluid Method for Perforation and Fracture Initiation, Society of Petroleum Engineers No. 1607-G: Journal of Petroleum Technology, pp. 489-495 (May 1961); Originally Presented at 31st Annual California Regional Fall Meeting of SPE, Pasadena, California (Oct. 20-21, 1960).

Buset, P., Riiber, M., Eek, A., Jet Drilling Tool Cost Effective Lateral Drilling Technology for Enhanced Oil Recovery, Society of Petroleum Engineers No. 68,504; Prepared for presentation at the SPE/ICoTA Roundtable, Houston, Texas (Mar. 7-8, 2001).

Summers, D.A., Iyoho, A.W., Galecki, G., Petroleum Applications of Emerging High Pressure Waterjet Technology, Society of Petroleum Engineers No. 26,347, Society of Petroleum Engineers 68th Annual Technical Conference and Exhibition, Houston, Texas (Oct. 3-6, 1993).

Summers, D.A., Yazici, S., Progress in Rock Drilling, Mechanical Engineering (Dec. 1989) http://www.rockmech.mst.edu/documents/paper157.pdf.

Olson, John H., Pumping Up the Waterjet Power, pp. 1-5 (Dec. 11, 2007) www.omax.com.

Summers, D.A., Recent Advances in the Use of High Pressure Waterjets in Drilling Applications, Advanced Mining Technology Workshop, NADET Institute, Colorado School of Mines, Golden, Colorado (Oct. 5-6, 1995) http://www.rockmech.mst.edu/documents/paper211.pdf.

Feenstra, R., Pols, A.C., Van Stevenick, J., Rock Cutting by Jets a Promising Method of Oil Well Drilling, Society of Petroleum Engineers No. 4,923, Publ. 425 (Sep. 1973) Presented at the 103rd AIME Annual Meeting, Dallas, Texas (Feb. 24-28, 1974).

Dickinson, W., Dickinson, R.W., Herrera, A., Dykstra, H., Nees, J., Slim Hole Multiple Radials Drilled with Coiled Tubing, Society of Petroleum Engineers No. 23,639: 2nd Latin American Petroleum Engineering Conference, Caracas, Venezuela (Mar. 8-11, 1992).

Smith Services, A Business Unit of Smith International, Inc., Smith International Inc Trackmaster PLUS Wellbore Departure Systems, Houston, Texas (Apr. 2005).

Summers, D.A., The Application of Waterjets in a Stressed Rock Environment, Third Conference on Ground Control Problems in the Illinois Coal Basin, Mt Vernon, Illinois (Aug. 8-10, 1990) http://www.rockmech.mst.edu/documents/paper158.pdf.

Haga, P.C., Lin, B., Roxborough, F.F., The Cuttability of Rock Using a High Pressure Water Jet, School of Mining Engineering, The University of New South Wales (1990) http://www.mining.unsw.edu.au/Publications/publications_staff/Paper_Hagan_WASM.htm.

(56) References Cited

OTHER PUBLICATIONS

Summers, D.A.; Henry, R.L., The Effect of Change in Energy and Momentum Levels on the Rock Removal in Indiana Limestone, 1st International Symposium on Jet Cutting Technology, Coventry, England (Apr. 1972) http://www.rockmech.mst.edu/ documents/paper10.pdf.
Summers, D.A., Weakly, L.A., The Effect of Stress on Waterjet Performance, 19th Symposium on Rock Mechanics, Lake Tahoe, Nevada (May, 1978) http://www.rockmech.mst.edu/ documents/paper53.pdf.
Summers, D.A., Brook, N.; The Penetration of Rock by High Speed Water Jets, Int. J. Rock Mech. Min. Sci. vol. 6, pp. 249-258 Pergamon Press (1969) Great Britain (Manuscript received Oct. 30, 1968) http://www.rockmech.mst.edu/ documents/paper4.pdf.
US Hose Corp, USHose Corporation Engineering Guide no. 350, Technical Specifications for USHOSE's Flexible Hoses, Romeoville, Illinois and Houston, Texas (Copyright 2006).
Summers, D.A., Henry, R.L., Water Jet Cutting of Sedimentary Rock, Journal of Petroleum Technology, pp. 797-802 (Jul. 1972) http://www.rockmech.mst.edu/documents/paper12.pdf.
Summers, D.A., Water Jet Cutting Related to Jet and Rock Properties, 14th Symposium of Rock Mechanics, Penn State University, University Park, Pennsylvania (Jun. 12-14, 1972) http://www.rockmech.mst.edu/documents/paper11.pdf.
Summers, D.A., Clark, G.B., Water Jet Penetration into Rock, (Nov. 1970) http://www.rockmech.mst.edu/ documents/paper5a.pdf.
Summers, D.A., Waterjet Applications Session Review, 5th Pacific Rim International Conference on Water Jet Technology, New Delhi, India (Feb. 3-5, 1998) http://www.rockmech.mst.edu/documents/paper231.pdf.
Well Enhancement Services, LLC, Radial Jet Enhancement Brochure, The Woodlands, Texas (Jun. 2009) www.wellenhancement.com.
Well Enhancement Services, LLC, Radial Jet Enhancement, 7-page article, The Woodlands, Texas (Jun. 2009) www.wellenhancement.com.
Halliburton, Hydra Jet Perforating Process Service Brochure for Hydra-JetSM Perforating Process Service (Sep. 2006) www.halliburton.com.
TIW Corporation, TIW Abrasive Jet Horizontal Drill, A Pearce Industries Company located in Houston, Texas (undated slides).
Vortech Oilfield Tools, LP, Vortech Oilfield Tools, www.Vortech-Inc.com; Technical publication for Vortech pulsating jet tools, Midland, Texas (undated).
Leach, S. J., Walker, G. L.; Phil. Trans. A, Application of High Speed Liquid Jets to Cutting, vol. 260, plate 60 (1966) http://www.physics.princeton.edu/.../fluids/leach ptrsl a290 295 66.pdf.
Cooley, W. C., Correlation of Data on Erosion and Breakage of Rock by High Pressure Water Jets, 12th U.S. Symposium on Rock Mechanics (USRMS), Rolla, Missouri (Nov. 16-18, 1970).
Labus, T. J., Energy Requirements for Rock Penetration by Water Jets, 3rd International Symposium on Jet Cutting Technology, Cranfield, Bedford, England (1976).
Summers, D. A., Lehnhoff, T. F., Water Jet Drilling in Sandstone and Granite, Proceedings from the 18th Symposium on Rock Mechanics, Keystone, Colorado (May 1977).
Rehbinder, G., A Theory About Cutting Rock with a Water Jet, Journal of Rock Mechanics and Rock Engineering, Springer Wein, vol. 12/3-4, pp. 247-257 (Mar. 1980) (Manuscript submitted Oct. 1979).
Maurer, W. C., Advanced Drilling Techniques Chapter 12: "High Pressure Jet Drills (Continuous)," pp. 229-301 (1980).
Hashish, M., Experimental Studies of Cutting With Abrasive Waterjets, 2nd U.S. Waterjet Conference, University of Missouri-Rota (May 1983).
Ford, L.M., Water Jet Assisted Mining Tools: What Type Assistance and What Type Mining Machine?, Energy Citations Database (ECD) Document #6474987 (1983) http://www.osti.gov/energycitations/product.biblio.jsp?osti id=6474987.
Kolle, J.J., A Comparison of Water Jet, Abrasive Jet and Rotary Diamond Drilling in Hard Rock, Tempress Technologies, Inc., Oil and Gas Journal vol. 96, Issue 16 (Apr. 20, 1998) http://www.tempresstech.com/bookshelf/5.pdf.
Momber, A.W., Kovacevic, R., An Energy Balance of High-Speed Abrasive Water Jet Erosion, Proceedings of the Institution of Mechanical Engineers, vol. 213 Part J, pp. 463-473 (Dec. 1998).
Orbanic, H., Junkar, M., Bajsic, I., LEBAR, An Instrument for Measuring Abrasive Water Jet Diameter, International Journal of Machine Tools & Manufacture, #49, pp. 843-849 (May 2009).
Summers, D.A., Yazici, S., Abrasive Jet Drilling: A New Technology, 30th U. S. Symposium on Rock Mechanics, Morgantown, West Virginia (Jun. 1989).
Mayerhofer, Michael J., SRV Proves Key in Shales for Correlating Stimulation and Well Performance, The American Oil & Gas Reporter, pp. 81-89 (Dec. 2010).
Dickinson, W., Dykstra, H., Nordlund, R., Dickinson, R., Coiled-Tubing Radials Placed by Water-Jet Drilling, SPE No. 26,348, SPE 68th ATCE, Houston, Texas, (Oct. 3-6, 1993).

* cited by examiner

DOWNHOLE HYDRAULIC JETTING ASSEMBLY, AND METHOD FOR STIMULATING A PRODUCTION WELLBORE

STATEMENT OF RELATED APPLICATIONS

This application claims the benefit of U.S. Provisional Patent Application 61/308,060 filed Feb. 25, 2010. That application is entitled "Downhole Hydraulic Jetting Assembly, and Method for Stimulating a Production Wellbore." That application is incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well stimulation. More specifically, the present disclosure relates to the stimulation of a hydrocarbon-producing formation by the formation of small lateral boreholes from an existing wellbore using a jetting assembly.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation penetrated by the wellbore. A cementing operation is typically conducted in order to fill or "squeeze" part or all of the annular area with columns of cement. The combination of cement and casing strengthens the wellbore and facilitates the zonal isolation, and subsequent completion, of certain sections of potentially hydrocarbon-producing formation (or "pay zones") behind the casing.

It is common to place several strings of casing having progressively smaller outer diameters into the wellbore. Typically, one of the main functions of the initial string(s) of casing is to isolate and protect the shallower, fresh water bearing aquifers from contamination by any other wellbore fluids. Accordingly, these casing strings are almost always cemented entirely back to surface. The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place.

Additional tubular bodies may be included in a well completion. These include one or more strings of production tubing placed within the production casing or liner. Each tubing string extends from the surface to a designated depth proximate a production interval, or "pay zone." Each tubing string may be attached to a packer. The packer serves to seal off the annular space between the production tubing string(s) and the surrounding casing.

In some instances the pay zones are incapable of flowing fluids to the surface efficiently. When this occurs, the operator may include artificial lift equipment as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. Gas lift valves, plunger lift systems, or various other types of artificial lift equipment and techniques may also be employed to assist fluid flow to the surface.

As part of the completion process, a wellhead is installed at the surface. The wellhead serves to contain wellbore pressures and direct the flow of production fluids at the surface. Fluid gathering and processing equipment such as pipes, valves, separators, dehydrators, gas sweetening units, and oil and water stock tanks may also be provided. Subsequent to completion of the pay zone(s) followed by installation of any requisite downhole tubulars, artificial lift equipment, and the wellhead, production operations may commence. Wellbore pressures are held under control, and produced wellbore fluids are segregated and distributed appropriately.

Within the United States, many wells are now drilled principally to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, "low permeability" typically refers to a rock interval having permeability less than 0.1 millidarcies.

In order to enhance the recovery of hydrocarbons, particularly in low-permeability formations, subsequent (i.e., after perforating the production casing or liner) stimulation techniques may be employed in the completion of pay zones. Such techniques include hydraulic fracturing and/or acidizing. In addition, "kick-off" boreholes may be formed from a primary wellbore in order to create one or more new directional or horizontally completed wellbores. This allows a well to penetrate along the plane of a subsurface formation to increase exposure to the pay zone. Where the natural or hydraulically-induced fracture plane(s) of a formation is vertical, a horizontally completed wellbore allows the production casing to intersect multiple fracture planes.

It is contemplated that there are thousands of pay zones in thousands of existing vertical wells that could be enhanced by the addition of horizontal boreholes. Such wells could be drilled radially from the existing primary or vertical wellbores. However, the existing wellbores likely have substantial technical constraints that make the process of forming lateral boreholes either physically difficult or completely cost-prohibitive. Such constraints to the conventional horizontal kick-off/build-angle/case-and-cement process may include:

(a) Existing wellbore geometry. If the existing production casing has a relatively small inner diameter ("ID"), the wellbore may not be able to accept the outer diameters ("OD's") of the downhole tools required to complete a lateral wellbore. Similarly, even if a conventional horizontal well can be drilled and cased, the resulting ID of the new inner string of casing may be too confining as to permit the requisite fracture stimulation treatment(s). Finally, even if wellbore geometry constraints are alleviated, the "telescoping down" result of adding new tubulars within existing tubulars may result in a necessarily reduced ID of production tubing. This can constrict production rates below profitable levels.

(b) Existing wellbore integrity. The existing production casing may not be capable of withstanding the equivalent circulating densities ("ECD's") of the casing milling/formation drilling fluids required to complete a lateral wellbore. Similarly, an open set of shallow, uphole perforations may impose the same constraint.

(c) Reservoir pressure depletion. The existing reservoir pressure may be insufficient to facilitate the ECD's of the casing milling/formation drilling process. Further, simply "killing" the well (i.e., pumping a hydrostatic column of fluid down hole to keep the well from flowing during recompletion operations) may pose significant risk to the reserves.

(d) Cost Constraints. Though substantive incremental additions to hydrocarbon production rates and EUR's may be gained from a conventional horizontal kick-off/build-angle/case-and-cement process, they still may not be enough to warrant the relatively large expenditure.

Given the above, it is understandable why there are generally more attempts at drilling new horizontal wells than there are recompletion attempts to add horizontal laterals to existing vertical wellbores.

A relatively new technique that has been developed to address the above-listed constraints involves the use of hydraulic jetting forces. Jetting forces have been employed to erosionally "drill" relatively small diameter lateral boreholes from an existing vertical well into a pay zone. In this technique, the "drilling equipment" is run into the existing wellbore and down to the pay zone, and then exits the wellbore perpendicular to its longitudinal axis. Depending on the specific technique employed, the transition from a vertical orientation to a horizontal orientation may or may not be accomplished entirely within the inner diameter of the existing production casing or liner at (or near) the level or depth of the pay zone.

According to the jetting technique, lateral boreholes are generally formed by placing a nozzle at the end of a string of "jetting hose." The jetting hose is typically ¼" to ⅝" OD flexible tubing that is capable of withstanding relatively high internal pressures. The parent well is "killed," and the production tubing is pulled out of the wellbore. A hose-bending "shoe" is attached to the end of the tubing string, and the production tubing, which is then re-run into the wellbore. The shoe is comprised of an assembly having an entry port at the top, and an exit port located below, providing a substantially 90-degree turn. Thus, in a vertical wellbore, the jetting hose is run through the tubing, and is directed into the shoe vertically. The jetting hose bends along the shoe, and then exits the shoe where it is directed against the ID of the casing at the point of the desired casing exit.

In this known jetting technique, the entirety of the required angle is typically "built" within the walls of the existing borehole. More specifically, the entire angle is built within the guide shoe itself. By necessity, the shoe has a smaller O.D. than the production casing's I.D. This serves as a significant limitation to the size of the jetting hose. In addition, the thickness of the guide shoe material itself further reduces the I.D. of the guide shoe and, hence, the bend radius available to the jetting hose. An example of such a limited-bend lateral jetting device is described in U.S. Pat. Publ. No. 2010/0243266 entitled "System and Method for Longitudinal and Lateral Jetting in a Wellbore."

In operation, the production tubing is landed at a point along the casing such that the exit port of the hose-bending shoe is adjacent to the pay zone interval of interest. A small casing milling device is attached to the end of the jetting hose, and run down inside the tubing. Some configurations involve a mechanically-driven mill, but most are configured such that the mill is rotated by use of hydraulic forces. The casing milling device is directed through the guide shoe and against the wall of the casing so as to form a casing exit, or window.

Once a window is milled through the casing wall, milling typically continues through the cement sheath, and a few inches into the pay zone itself. The mill and milling assembly is then tripped out of the hole by "spooling up" the jetting hose, and is replaced by a hydraulic jetting nozzle. The jetting nozzle and jetting hose are then spooled back into the tubing, passed through the guide shoe, run through the new casing exit, and then urged laterally through the pay zone, beginning at the point milling operations previously ceased.

A high pressure pump capable of pumping fluids at discharge pressures of several thousand psi, and at rates of several gallons per minute, is an integral part of the surface equipment for this configuration. The high-pressure pump must discharge an adequate volume of fluid at sufficient pressures as to overcome the significant friction losses through the small I.D. jetting hose, and generate sufficient hydraulic horsepower exiting the small holes in the jetting nozzle to erode, or "jet," a borehole in the formation itself. As the borehole is eroded in the selected pay zone, the jetting hose is continuously fed to enable the process to extend radially from the original wellbore, out into the pay zone.

Once either the desired or maximum achievable length of the horizontal borehole is reached, the jetting nozzle and hose are "spooled up" and retrieved from the borehole. Fluid may continue to be injected during retrieval so as to allow rearward thrusting jets in the jetting nozzle to clean the new borehole and possibly expand its diameter. The jetting nozzle and hose are further reeled back through the guide shoe and tubing, and back to the surface. Upon retrieval, the production tubing (with the guide shoe still attached) is then rotated, say, a quarter-turn. Assuming the downhole rotation of the guide shoe is directly proportional to the surface rotation of the production tubing (an assumption that is less and less likely proportional to the vertical wellbore's depth and tortuosity), the guide shoe is then also reoriented at the desired 90-degrees from the azimuth of the original lateral borehole, and the process is repeated. Commonly, the process would be repeated three times, yielding four perpendicular boreholes, or "mini-laterals."

It is significant to note that the two known commercially-available forms of this process do not contemplate either measurement or control of the exact path of the mini-laterals, though they do claim lateral lengths of 300 to 500 feet from the original wellbore. In actuality, neither real-time measurement nor control of the lateral path may be necessary, as deviations from the original trajectory of the horizontal path from the wellbore may be insignificant. Authors, such as Summers, et al. (2002), have noted that fluid jet systems are "not susceptible to the geologically induced deviations encountered with mechanical bits, since no mechanical contact is made with the rock while drilling.", while Kolle (1999) has beneficially noted "jet erosion requires no torque or thrust, high pressure jet drilling provides a unique capability for drilling constant radius directional hole without the need for steering corrections."

Darcy and Volumetric calculations may be made to determine the anticipated increases in production rates and recoverable reserves from the formation of horizontal mini-lateral boreholes off of an existing vertical wellbore. First, using a gas well as an example, the Darcy equation may be used to compute gas production rate:

$$Q_g = \frac{703kh(P_e^2 - P_w^2)^n}{\mu z T \ln(r_e / r_w')}$$

where $Q_g$=gas production rate (MCFPD)

k=formation permeability (Darcy's)

h=average formation thickness (feet)

$P_e$=reservoir pressure at the drainage radius (psia)

$P_w$=bottom-hole flowing pressure (psia)

n=deliverability coefficient (dimensionless)

μ=viscosity (cp)

z=gas compressibility factor (dimensionless)

T=temperature (° R=° F.+460)

$r_e$=external (i.e., "drainage") radius (feet)

$r_w'$=the effective parent wellbore radius, as computed from the van Everdingen skin factor ("S") equation, $$S = -\ln(r_w'/r_w)$$

where $r_w$ is the radius of the parent wellbore as drilled (ft).

The Volumetric Equation can be employed to compute the recoverable gas reserves:

$$G_p = 0.001*(\pi*r_e^2)*h*\phi*(1-S_w)*[(1/B_{gi})-(1/B_{ga})]$$

where $G_p$=remaining recoverable gas reserves (MSCF)

$r_e$=external (i.e., "drainage") radius (feet)

h=average formation thickness (feet)

ϕ=porosity (%)

$S_w$=water saturation of the pore spaces (%)

$B_{gi}$=initial gas formation volume factor $B_{ga}$=gas formation volume factor at abandonment $$B_g = \left[\frac{14.65}{P_R + 14.65}\right]\left[\frac{T_R(^\circ\ \text{F.}) + 460}{460 + 60(^\circ\ \text{F.})}\right] * Z$$

where assuming $P_{Rab}$=200 psia

Z=gas compressibility factor (dimensionless)

As example of a projection may be taken from an actual gas well in Hemphill County, Texas. This is the Centurion Resources, LLC's Brock "A" #4-63. The subject well was completed in the Granite Wash 'A' formation, at a mid-point depth of perforations at a depth of 10,532 feet. The pay zone is 68 feet thick, having an original reservoir pressure of 4,000 psia. The deliverability coefficient, "n", is equal to 0.704.

The average formation porosity is assumed to be 10%, while the water saturation is about 40.9%. The average reservoir pressure at abandonment was 200 psia.

Given the "p" and "z" values obtained from correlations for the actual gas sampled, and using the actual bottom-hole temperature and pressures observed, solving for "k" suggests a formation permeability of 4.37 millidarcies. Note that these "original condition" calculations reflect an $r_w'=r_w$=0.328 feet, or half of the original 7⅞ inch hole diameter.

For purposes of the calculation, it is assumed that the well has been, and will continue to be, produced at a constant bottom-hole flowing pressure of 100 psia. It is further assumed that the well will drain a perfectly radial reservoir volume, and that the reservoir is cylindrical. It is still further assumed that, after perforating, the subsequent acid job eliminated all formation damage induced by drilling and cementing such that the subsequent post-acid (pre-frac) skin factor, "S", was equal to zero, at which point the steady-state flow rate was 213 MCFPD.

TABLE 1 below, is provided as a columnar summary of the data from the above Darcy and Volumetric equations.

| Darcy Equation, Radial Flow, Gas (with Skin) $Q_g = \frac{703kh(P_e^2 - P_w^2)^n}{\mu z T \ln(r_e / r_w')}$ | Original Completion (Post-Acid) | Original Completion (Post-Frac) | Depletion Case (Post-Frac) | Depletion Case (Post-Frac, + Laterals) |
|---|---|---|---|---|
| $Q_g$ | 213 | 563 | 77 | 108.95 |
| K | 0.00437 | 0.00437 | 0.00437 | 0.00437 |
| $P_e$ | 4,000 | 4,000 | 700 | 957.13 |
| $P_w$ | 100 | 100 | 100 | 100 |
| μ | 0.0231 | 0.0231 | 0.0143 | 0.0143 |
| z | 0.94077 | 0.94077 | 0.94394 | 0.94394 |
| T | 670 | 670 | 6670 | 670 |
| $r_e$ | 912.10 | 988.49 | 988.49 | 1,412.10 |
| (implies a drainage area in Acres) | 60.00 | 70.47 | 70.47 | 143.81 |
| $r_w'$ | 0.328 | 48.958 | 48.958 | 51.409 |
| S | 0.00000 | −5.00533 | −5.00533 | −5.05418 |
| exposed sand face ($ft^2$) | 140.19 | 20,917.77 | 20,917.77 | 21,964.97 |
| Equivalent fracture wing (ft) (calculated from the assumed value of "S") | | 76.39 | 76.39 | 80.24 |

| Volumetric Gas Reserves Calculations $Gp = .001 * (\pi * r_e^2) * h * \phi * (1 - S_w) * [(1/B_{gi}) - (1/B_{ga})]$ | Original Completion (Post-Acid) | Original Completion (Post-Frac) | Depletion Case (Post-Frac) | Depletion Case (Post-Frac, + Laterals) |
|---|---|---|---|---|
| $G_p$ (MCF) | 2,255.281 | 2,648.858 | 371,018 | 1,133,419 |
| $r_e$ | 912.10 | 988.49 | 988/49 | 1,412.10 |
| $S_w$ | 40.9% | 40.9% | 40.9% | 40.9% |

TABLE 1-continued

| below, is provided as a columnar summary of the data from the above Darcy and Volumetric equations. | | | | |
|---|---|---|---|---|
| $B_{gi}$ | 0.00444 | 0.00444 | 0.02459 | 0.01798 |
| $B_{ga}$ | 0.09426 | 0.09426 | 0.09426 | 0.09426 |
| Z | 0.94077 | 0.94077 | 0.91175 | 0.91175 |

A can be seen, four columns of data are provided. These are:

1) Original Completion (Post-Acid) This column represents calculations of anticipated gas production rate and remaining recoverable gas reserves in place at the time of well completion. The calculations assume that the pay zone receives stimulation from acidization only.
2) Original Completion (Post-Frac) This column represents calculations of anticipated gas production rate and remaining recoverable gas reserves at the time of well completion. The calculations assume that the pay zone receives stimulation from both acidization and hydraulic fracturing. Subsequent to the well's hydraulic fracture treatment, actual production history from the Brock "A" #4-63 suggests that an equivalent, steady-state production rate of approximately 563 MCFPD was achieved. Assuming that the hydraulic fracturing stimulation of the pay zone effectively reduced the Skin factor "S" from zero to a value of −5.0, then back-calculating from Darcy's equation suggests that the effective wellbore radius, $r_w'$, was enlarged from the original 0.328 feet to a value of approximately 49 feet. Geometrically, this would be the equivalent of an infinite-conductivity fracture having a wing length of 76.4 feet.
3) Depletion Case (Post-Frac) This column presents calculations from the actual gas production rate (77 MCFPD) and remaining recoverable gas reserves (371,018 MSCF) at 2009, subsequent to both acidization and hydraulic fracturing upon original completion.

Note that at current conditions, the reservoir pressure at the external limits of the drainage radius ($r_e$) has declined from the original 4,000 psia to a value of 700 psia. As with the value of $r_w'$ in the previous case, the $P_e$ value of 700 psia was determined iteratively, forcing the remaining reserves ("$G_P$") calculation to align with the Expected Ultimate Recovery ("EUR") value of 2.649 BCF.

The modeling of an "infinite conductivity" fracture would suggest that the constant bottom-hole flowing pressure of 100 psi may now be superimposed to a distance equal to the wing length from the wellbore, that is, 76.4 feet. For volumetric calculations, maintaining the cylindrical "tank" model requires that the drainage radius also extend 76.4 feet, from the "Original Completion (Post-Acid)" value of 912 feet (60-acre equivalency) to an "Original Completion (Post-Frac)" value of 988.49 feet (70.5-acre equivalency).

Note particularly that the $r_w'$ value of 48.958 feet was determined iteratively, in that it forces the $G_P$ value of 2.649 BCF (2,648,858 MCF) to match the Expected Ultimate Recovery ("EUR") estimate from decline curve analysis of the actual production rate-vs-time data compiled from approximately 30 years of actual production history (1979 through 2009). Given that the actual production history represents a cumulative production of 2.356 BCF, or approximately 90% of the EUR, the EUR estimate of 2.649 BCF is accompanied by a relatively high degree of confidence.
4) Depletion Case (Post-Frac+Laterals) This column presents calculations of the anticipated gas production rate (109 MCFPD, for a 32 MCFPD, or 42%, increase from 77 MCFPD) and remaining recoverable gas reserves (1,133,419 MCF, for a 762,401, or 205% increase, from 371,018 MCF), assuming eight "mini-lateral" boreholes are to be added in 2009. Each borehole represents a 1" diameter hole that is jetted. Four mini-laterals are jetted at two different depths within the overall 68-foot thick pay zone, producing a total of eight lateral boreholes. Each mini-lateral is 500 feet long. This extends the circular drainage radius to a point 1,412 feet from the original wellbore.

The previous "Depletion Case (Post-Frac)" pressure gradient through the reservoir ($P_e$=700 psia at the external drainage radius limit of 988 feet, to the constant bottom-hole flowing pressure of 100 psia observed in the wellbore; e.g., 600 psia/988 feet=0.607 psia/ft) can be extended to the new drainage radius of 1,412.0 feet. This generates a new value of $P_e$=957.13 psia.

As with the modeling of the hydraulic fracture upon initial completion (Column 2), the effective wellbore radius, $r_w'$, is increased geometrically in proportion to the amount of additional sand face exposure. Note, whereas a fracture half-length (i.e., "wing" length, $x_f$) of 76.4 feet penetrating the entire 68 foot reservoir thickness makes a significant impact upon $r_w'$ (increasing it from 0.328 feet to 48.96 feet), the incremental increase in $r_w'$ from the 8 mini-laterals addition is relatively small (48.96 feet to 51.41 feet, for a net increase of 2.451 feet). Also note, however, had the subject well never been fractured, a 2.451 feet increase in the original $r_w'$=0.328 would have been significant, increasing same by 647%.

Accordingly, from the calculations in the column of Table 1 labeled "Depletion Case (Post Frac+Laterals)" (Column 4), a theoretically anticipated increase in production rate of 42% (e.g., from 77 MCFPD to 109 MCFPD) would be expected. This represents an increase of 32 MCFPD. Of even greater significance would be the correlative anticipated increase in remaining reserves from 371,018 MCF to 1,133,419 MCF. This is an increase of 762,401 MCF, or 205%. Note that the addition of the 8 mini-lateral boreholes would thereby raise the overall (post-frac) EUR from 2,648,858 MCF to 3,411,259, for an increase of 29%.

The above example of Table 1 demonstrates how the creation of small, jetted, radial boreholes in an existing well can enhance production from the primary wellbore, even in the final stages of the well's productive life. A significant increase in daily production and remaining reserves is achieved even though the parent well was stimulated by both acidizing and hydraulic fracturing upon initial completion.

The hydraulic jetting of "mini-laterals" may be conducted to enhance fracture and acidization operations during completion. As noted, in a fracturing operation, fluid is injected into the formation at pressures sufficient to separate or part the rock matrix. In contrast, in an acidization treatment, an acid solution is pumped at bottom-hole pressures less than the pressure required to break down, or fracture, a given pay zone. Examples where the jetting of min-lateral boreholes may be beneficial include:

(a) Jetting radial laterals before hydraulic fracturing in order to confine fracture propagation within a pay zone and to deliver fractures a significant distance from the wellbore before any boundary beds are ruptured. Preferably, fractures would propagate from the mini-lateral wellbores in a vertical orientation. This would be expected in formations that are deeper than about 3,000 feet.

(b) Using "mini-laterals" to place stimulation from a matrix acid treatment well beyond the near-wellbore area before the acid can be "spent," and before pumping pressures approach the formation parting pressure.

There are also situations in which radial hydraulic jetting of "mini-laterals" may be the preferred reservoir stimulation technique in place of hydraulic fracturing. In hydraulic fracturing, an operator generally has rather limited control over the final geometric configuration of a hydraulic fracture as it is generated radially from a given wellbore. Certainly, the operator can control such things as pumping rates, pumping pressures, fluid rheology, proppant type, and fluid concentrations. These parameters can influence the dimensions of the fractures, primarily their length. However, many of the final determinants of fracture geometry are indigenous to the pay zone and the boundary formations themselves. For example, for shale gas formations at depths greater than about 3,000 feet, fractures tend to form vertically. This is because fractures tend to propagate in a given pay zone in a direction that is perpendicular to the rock matrix's plane of least principal stress. Thus, a hydraulic fracture may undesirably grow beyond the pay zone and into the boundary formations above and/or below the pay zone.

A related situation in which geometric control issues may come into play with reservoir stimulation is in reservoirs having fluid "contacts." For example, when an oil/water or gas/water contact exists, either fracturing or acidizing can result in creating a direct, enhanced flow path for unwanted water. Similarly, when a gas/oil contact exists, and gas cap expansion is the primary reservoir drive mechanism, fracturing or acidizing may result in excessive, unwanted gas production along with, or in place of, the oil. Accordingly, in these situations it is not uncommon to see pay zone completions without any stimulation subsequent to perforating. These are particularly strong candidates for receiving benefits from hydraulic jetting of "mini-lateral" boreholes.

Other situations exist where jetting a "min-lateral" is preferred over known hydraulic fracturing operations. These may include:

(a) Reservoirs where the pay zone is bounded, either above and/or below, by formations with rock strength characteristics of insufficient contrast to those of the pay zone itself. In these situations, it is particularly difficult to create conductive fracture length within the pay zone, as the weak bounding bed(s) may allow unwanted fracture height growth out of the pay zone.

(b) Reservoirs where pay zones are relatively thin, and/or aerially irregular, and/or spread vertically over a large vertical interval, such that hydraulic fracturing is not an effective (and particularly, not cost-effective) means of stimulation.

(c) Reservoirs where the pay zone has a significant indigenous heterogeneity in its permeability system, such as natural fractures that are either directional and/or discontinuous in nature. Here, the main objective is not so much to create a secondary flow path with a large permeability contrast to the pay zone's matrix, but to simply "link-up" the indigenous preferential flow paths that already exist.

Hence, in situations where controlling the direction of stimulation (particularly, in the vertical), and/or controlling the distance (radially, away from the wellbore) of stimulation is critical, hydraulic jetting of "mini-laterals" may be more beneficial, and cost-effective, than conventional stimulation techniques.

A foundational work in the area of rock removal using hydraulic jets is that of Maurer, in his 1969 paper entitled "Hydraulic Jet Drilling." Later, in 1980, Maurer expanded and updated his work in a book entitled *Advanced Drilling Techniques*, particularly in Chapter 12 entitled "High Pressure Jet Drills—Continuous." In these works, Maurer compiled, analyzed, and discussed laboratory, and actual field trials of various rock drilling operations with hydraulic jets. Maurer highlighted the fundamental relationship between a rock's "drillability" to its commensurate "Specific Energy Requirement." In this context, "Specific Energy Requirement" is denoted as "SER" and is defined as follows:

SER={[the power input required to erode a unit volume of rock]×[the time required to erode a unit volume of rock]}/[the volume of rock eroded]

The units of SER will be presented herein as:

$$\frac{\text{Power}\times\text{Time}}{\text{Volume}} = \frac{\text{Horsepower}-\text{Hours}}{\text{Feet}^3} \text{ or } \frac{\text{Joules (J)}}{\text{Cubic}-\text{Centimeter (cm}^3)} = \frac{\text{Mass}}{\text{Length}\times(\text{Time})^2}$$

Given the above definition of SER, a linear plot of Required Power Output (at the jetting nozzle), or "P.O." (in units of hydraulic horsepower), versus Erosion Rate, "$E_R$" (in units of cubic feet per hour), will yield a relationship whose slope or first derivative, $d(P.O.)/d(E_R)$ equals the Specific Energy Requirement, SER, to erode a unit volume of a given rock (in units of horsepower-hours per cubic feet).

FIGS. 1A and 1B represent such relationships for hydraulic jetting erosion. FIG. 1A provides a Cartesian coordinate plotting Power Output (P.O.) as a function of Erosion Rate ($E_R$) for a Darley Dale Sandstone. This figure is based on Maurer's "Table III" data. Similarly, FIG. 1B provides a Cartesian coordinate plotting Power Output (P.O.) as a function of Erosion Rate ($E_R$) for a Berea Sandstone. This figure is based on Maurer's FIG. 15 and FIG. 16.

The lines showing the correlations for the Darley Dale Sandstone and the Berea Sandstone are shown at 110A and 110B, respectively.

In FIG. 1A, line 110A is defined by the function:

$$P.O.=12+45(E_R)^{1.85} \text{ horsepower.}$$

In FIG. 1B, line 110B is defined by the function $$P.O.=51+5.5(E_R)^{1.70} \text{ horsepower.}$$

Note that for both formations, the general form of the relationship for P.O. is:

$$P.O.=(P.O.)_{th}+a(E_R)^b$$

Where: "$(P.O.)_{th}$" is the threshold Power Output for a given nozzle configuration, required to commence erosion of a given rock.

The actual numeric values for the coefficients, "a" and "b", will be dependent upon such factors as:

1. the jetting nozzle configuration;
2. the viscosity, compressibility, and abrasiveness of the jetting fluid;
3. the compressive strength, Young's modulus, and Poisson's ratio, etc., of the rock itself, which, in turn will be influenced by the in situ pore pressure, fluid saturation(s), and confining pressures (i.e., in situ stress orientations and magnitudes); and
4. other specific features inherent to the rock itself, such as formation type (sandstone, limestone, dolomite, shale, etc.) and more specifically, whether the rock matrix is crystaline or granular in nature; and, if granular, the composition and strength of intergranular cementation; occurrence and orientation of bedding planes; magnitude and variation of primary and secondary porosity (such as indigenous natural fractures); and relative permeability to the jetting fluid.

The Specific Energy Requirement (SER) can be computed by taking the derivative of the P.O. equation, above. The SER values are defined by the equation:

$$SER = \frac{d(P.O.)}{d(E_R)} = a * b(E_R)^{[b-1]}$$

The lines showing the SER values are seen at 120A and 120B for FIGS. 1A and 1B, respectively.

Technical literature has suggested that, for a fixed P.O. or SER, increasing the erosional penetration rate of a given rock (which would correspond to reductions of the "a" and/or "b" coefficients) may be accomplished by one or more of the following:

1. including abrasives in the jetting fluid;
2. impacting the rock surface with an intermittent (as opposed to continuous) jetting stream, otherwise known as a "pulsed" jet; or,
3. traversing the jetting stream across the targeted rock surface.

Maurer's objective was not to maximize hole diameter, but to optimize penetration rates and power requirements for a fixed hole diameter. He defined his "optimum pressure" as the point at which the Specific Energy passed through a minimum as the pressure through a hydraulic jet was increased, corresponding to the pressure at which maximum drilling rate would occur for a given size pump. The optimum pressure for Berea Sandstone is about 5,000 psi. Thus, Maurer concluded that "the optimum drilling pressure is not necessarily the maximum pressure rating of the available pumps."

Maurer related the drilling rate, "R" (in inches per minute) to the Specific Energy required to remove a unit volume of rock, "E", by the equation:

$$R = \frac{P}{A \times E}$$

where

P=power transmitted to rock (ft-lb/minute);

A=hole cross-sectional area (inches$^2$); and

E=Specific Energy (ft-lb/inches$^3$).

Hence, for a continuous jetting stream eroding a fixed hole cross-sectional area, "A", maximum rock penetration rate will be achieved by simultaneously delivering the maximum hydraulic horsepower ("P") at the "optimum" (or, minimum) Specific Energy Requirement ($E_R$) to remove rock.

Technical literature also suggests that sandstone and limestone formations will tend to exhibit an elastic-plastic failure response. This indicates that an erosion process using hydraulic jetting corresponds to the compressive strength of the rock.

In a work published by Labus in 1976 entitled, "Energy Requirements for Rock Penetration by Water Jets," a close correlation was demonstrated between the log-log relationships of Specific Energy to a term Labus quantified empirically as "Specific Pressure." Labus defined Specific Pressure as:

$$P_{Sp} = \frac{P_J}{\sigma_M}$$

where $P_{Sp}$=Specific Pressure;

$P_J$=Jet impact pressure; and $\sigma_M$=Rock compressive strength.

Note that when $P_J$ and $\sigma_M$ are measured in the same units, $P_{Sp}$ is dimensionless.

Labus found that the Specific Energy ("SE") data can be normalized by plotting it against the Specific Pressure (ratio of jet pressure to rock compressive strength). Labus hypothesized that Specific Energy (SE) varies to the −1.035 power of Specific Pressure ($P_{Sp}$). Labus expressed his correlation of Specific Energy to Specific Pressure as follows:

$$\text{SE (joules/cc)} = 146{,}500 \times P_{Sp}^{-1.035}$$

Converting the above to the units of Specific Energy Requirement (SER) in horsepower-hours per cubic feet yields:

$$\text{SER (hp-hrs/ft}^3) = 1{,}545 \times P_{Sp}^{-1.035}$$

This is of the form:

$$\text{SER} = c\, P_{Sp}^{d}$$

Accordingly, we now have two independent relationships for the SER. Note that by equating these two relationships, a relationship for the Erosion Rate, $E_R$, can be derived:

$$E_R = \left[\frac{c}{a \times b}\right]^{(1/b-1)} \times \left[\frac{P_J}{\sigma_M}\right]^{(d/b-1)}$$

Note that the above relationship should hold true for any set of operating conditions within which $P_J > P_{Th}$.

As applied to the context of hydraulic jetting, Bernoulli's Equation provides:

$$\text{P.O.} = P_s \times Q$$

where

P.O.=required power output at the jetting nozzle;

Q=volume flow rate, or "pump rate" of the jetting fluid; and $P_J$=jet impact pressure The equation may be written in terms of horsepower as follows:

$$\text{P.O. (hp)} = 0.00007273\, P_J\,(\text{psi}) \times Q\,(\text{ft}^3/\text{hr}).$$

This may be substituted into an erosion rate calculation in the following manner:

$$E_R = .00007273\frac{Q}{a}(P_J - P_{Th})^{(1/b)}$$

where $E_R$=erosion rate;

Q=volume pump rate of the jetting fluid;

$P_J$=jet impact pressure;

$P_{Th}$=threshold pressure; and a and b are coefficients as described above.

It is believed that the achievable Erosion Rate, $E_R$, of a radial lateral being hydraulically eroded will be exponentially proportional to the difference by which the jetting pressure ($P_J$) exceeds the threshold pressure ($P_{Th}$). It is also believed that the achievable Erosion Rate, $E_R$, of a radial lateral being hydraulically eroded will be exponentially inversely proportional to the compressive strength ($\sigma_M$) of the rock being bored. In addition, assuming that the jet impact pressure ($P_J$) is greater than the threshold pressure of the rock ($P_{Th}$), the achievable Erosion Rate ($E_R$) of a radial lateral being hydraulically jetted will be linearly proportional to the pump rate (Q) that can be achieved.

For both rocks for which hydraulic drilling penetration (e.g., P.O. vs. $E_R$) data could be compiled, (Darley Dale and Berea sandstones) the coefficient b is greater than 1.0. As long as:

$P_J > P_{Th}$, and b>1.0, the dominant determinant of $E_R$ will not be the jetting pressure ($P_J$), but will be the pump rate (Q). Hence, the ultimate success of any lateral borehole erosional system will be governed by how effectively the system can put the maximum hydraulic horsepower output (P.O.) at the jetting nozzle, and specifically, by how well the system can maximize the pump rate (Q) at jetting pressures ($P_J$) greater than the threshold pressure ($P_{Th}$).

It is noted here that the units of Erosion Rate, $E_R$, are in units of rock volume per unit of time (e.g., $ft^3$/hour), as opposed to technical literature that typically deals in penetration rates (i.e., distance per unit of time, such as ft/hour). The latter presupposes a fixed hole diameter. The motivation of basing a system model on $E_R$ is to provide for optimization of both penetration rate and hole diameter for a given system. In this respect, it may be more effective to hydraulically form laterals at lower penetration rates if substantial gains can be made in resultant lateral borehole diameters. This optimization process, as applied to the subject method and invention for a given oil and/or gas reservoir rock of compressive strength ($\sigma_M$) and threshold pressure ($P_{Th}$), will then be a process of utilizing the pressure and rate capacities of a given coiled tubing and jetting hose configuration to maximize the Power Output (P.O.) at the jetting nozzle.

Once maximum P.O. is delivered to the jetting nozzle, the selection of a particular nozzle design will dictate corresponding values of the coefficients "a" and "b," for a given rock compressive strength ($\sigma_M$). Optimum nozzle selection will then be based upon obtaining a maximum hole diameter at a satisfactory penetration rate. As discussed further below, nozzle design refers primarily to the selection of the number, spacing, and orientation of the nozzle's fluid portals.

A rate-pressure hydraulic horsepower optimization process presumes, as previously stated, a $P_J > P_{Th}$. In addition, it assumes a minimum pump rate ($Q_{min}$) that will provide sufficient annular velocities in the horizontal borehole that provides for sufficient hole cleaning of the generated "cuttings," that is, the jetted rock debris. Hence, limitations relevant to optimum jetted-hole configuration in a given oil and/or gas reservoir are those limitations imposing losses of hydraulic horsepower at the jetting nozzle. However, other limitations to hydraulic jetting systems, particularly those for creating radial mini-laterals, exist. Those limitations generally include:

(a) limited hydraulic horsepower (P.O.) at the jetting nozzle;

(b) vertical depth limitations for candidate pay zones; and (c) wellbore geometry limitations.

These are discussed separately, below.

Limited hydraulic horsepower at the jetting nozzle. Anything that diminishes or restricts the jetting pressure ($P_J$), or the jetting fluid's "pump rate" ($Q_J$) constitutes a limitation to the hydraulic horsepower (P.O.) of the fluid jet impacting the target rock. Working from the jetting nozzle back toward the surface equipment, these limiting factors include:

(1) The inefficiencies in the nozzle itself, such that selection of the number, spacing, and orientation of the nozzle's fluid portals do not provide optimum values of the "a" and "b" coefficients when jetting through the rock matrix. Accordingly, the pressure drop inherent in the nozzle is not yielding the maximum possible benefits.

(2) The pressure loss due to friction of the jetting fluid as it is being pumped through the jetting hose. The longer the jetting hose is, the greater the amount of pressure loss due to line friction. However, limiting the length of jetting hose invokes a directly proportional limit in the potential length of the lateral borehole.

(3) The burst pressure of the hose, particularly at the bend radius. The erosion of in situ reservoir rocks necessitates relatively high surface pumping pressures. These pumping pressures, in addition to the hydrostatic head of the jetting fluid column downhole, invoke burst forces that must be withstood by the jetting hose throughout its entire length. This internal burst force is at a maximum if there are no (or limited) jetting fluid "returns" circulating back toward the surface in the annular region outside the jetting hose and within the wellbore, thereby providing supportive hydrostatic forces from the outside. Regardless of the materials comprising the jetting hose itself (be it continuous stainless steel, stainless steel with a supporting braided steel exterior, or elastomeric materials), the limiting burst pressure will always occur at the maximum point of flexure in the bending of the hose. This is why hoses are specified by both Maximum Working Pressure and Minimum Bend Radius. Accordingly, the jetting hose must have sufficient burst strength and, more importantly, because the jetting hose must be capable of making a 90-degree bend within a relatively small radius (conforming to the bending device positioned opposite the point of casing exit), sufficient burst strength within a state of flexure.

Vertical depth limitations for candidate pay zones. At present, the commercial processes available for executing a complete vertical-to-horizontal transition within a well casing, exiting the casing, and jetting the horizontal lateral(s) limit themselves to depths of approximately 5,000 feet or less. There are two plausible reasons for this depth limitation:

(1) The commercially available methods are provided via equipment designed for specific geologic basins. If the majority of pay zones in those basins are at depths of 5,000 feet or less, outfitting equipment with, say, 10,000 feet of coiled tubing would needlessly double the friction losses encountered in the coiled tubing prior to the jetting fluid reaching the jetting hose. In this respect, the jetting fluid must be pumped through all of the coiled tubing prior to reaching the jetting hose, whether the coiled tubing is extended into the wellbore or still coiled at the surface.

(2) Technically, the only limitations constraining the penetrability of a given formation by hydraulic jetting are the rock's strength characteristics, and particularly, those rock characteristics resisting erosion by the hydraulic forces emanating from the jets. Such characteristics include ($\sigma_M$) and ($P_{Th}$). Hence, in theory, if the P.O. at the nozzle can exceed these erosional thresholds of the formation, a successful jetting process should occur independent of the depth of the host rock.

In general, however, ($\sigma_M$) and ($P_{Th}$) tend to increase with depth. In this respect, as the overburden pressure from the weight of overlying rock layers increases (which is directly related to depth), the resultant confining forces and stresses tend to increase ($\sigma_M$) and ($P_{Th}$). Similarly, favorable oil and gas reservoir characteristics such as porosity and permeability, in general, tend to decrease with depth.

Wellbore geometry limitations. The current methods for executing a vertical-to-horizontal transition within a well casing, exiting the casing, and subsequently jetting horizontal mini-lateral(s) requires full casing inner diameter access. This means that a workover rig (or, "pulling unit") is required to trip existing production tubing out of the hole. U.S. Pat. No. 5,852,056 issued to Landers, for example, then requires attachment of a deflection shoe to the end of the production tubing. The shoe is landed at the depth of the intended casing exit.

In order to conduct this operation, either the well is "killed", such that it cannot flow during the tripping operation, or a rather expensive and time-consuming "snubbing unit" is employed to snub the production tubing in and out of the wellbore. Note that in the first case, particularly, the well cannot be produced throughout the entire operation. Further, killing the well introduces a risk of possible formation damage. In this respect, it is not uncommon (particularly in somewhat pressure-depleted reservoirs) for kill fluids themselves to partially invade the producing formation in the near-wellbore area, and unfavorably alter the relative permeability to oil and/or gas. In partially depleted tight gas producing formations, for example, this is frequently evidenced by a substantial portion of the kill fluid never being recovered.

Therefore, a need exists for a system that provides for substantially a 90-degree turn of the jetting hose opposite the point of casing exit, while utilizing the entire casing inner diameter as the bend radius for the jetting hose, thereby providing for the maximum possible inner diameter of jetting hose, and thus providing the maximum possible hydraulic horsepower to the jetting nozzle. A need further exists for a system that includes a whipstock at the end of a string of coiled tubing, wherein the whipstock can be run through a "slim hole" region, and then set in a string of production casing having a relatively larger inner diameter. Such slim hole regions may include not only strings of intermediate repair casing, but also strings of production tubing. A need further exists for improved methods of forming lateral wellbores using hydraulically directed forces, wherein the desired length of jetting hose can be coupled onto any fixed length of coiled tubing. A need further exists for a method of forming lateral boreholes using hydraulically directed forces, wherein production of a flowing well may continue throughout the process of jetting lateral boreholes, and any uplift in flowing production rate may be observed in real time.

SUMMARY OF THE INVENTION

The systems and methods described herein have various benefits in the conducting of oil and gas production activities. First, a downhole tool assembly for forming a lateral wellbore from a parent wellbore is provided. The lateral wellbore is formed using hydraulic forces that are directed through a jetting hose. The parent wellbore has been completed with a string of production casing defining an inner diameter. The parent wellbore may also has a slimhole region having an inner diameter that is less than the inner diameter of the production casing.

The downhole tool assembly serves as a jetting assembly. Generally, the tool assembly first includes a hose-bending section made up of one or more whipstock segments, each having a curved face. The hose-bending section is designed to guide the jetting hose such that the bend radius of the jetting hose is equivalent to the full available I.D. of the production casing.

In one aspect, the hose-bending section comprises a bottom whipstock member and a top-whipstock member. The bottom whipstock member is rotatable from a first run-in position that allows the hose-bending section to be run through the optional slimhole region of the wellbore, to a second set position that causes the bottom whipstock member to traverse substantially across the inner diameter of the production casing below the slimhole region. When the bottom whipstock member is rotated to its set position, the top whipstock member may be abutted with the bottom whipstock member. In this way, the curved faces of the top whipstock member and the bottom whipstock member meet to form a unified bend radius across the full inner diameter of the production casing.

Preferably, the curved face of the top whipstock member and the curved face of the bottom whipstock member together are configured to receive the hose and redirect the hose about 90 degrees. This allows a lateral wellbore to be formed that is perpendicular to the orientation of the wellbore. Where the parent wellbore is completed vertically, the lateral wellbore will be formed horizontally.

In one embodiment, the tool assembly also includes a bottom tubular body (or kick-over section) and a bottom kick-over hinge. The bottom tubular body has an inner diameter and an outer diameter, and an upper end and a lower end. The bottom kick-over hinge is pivotally connected to the lower end of the bottom tubular body. The bottom kick-over hinge allows the bottom tubular body to be rotatable from a first position aligned with a major axis of the hose-bending section, to a second position against an inner wall of the production casing.

In this embodiment, the outer diameter of the bottom tubular body is dimensioned to pass through the slimhole region. In addition, the bottom whipstock member is pivotally connected to the upper end of the bottom tubular body.

It is preferred that the bottom kick-over hinge also be pivotally connected to an orienting member. The orienting member, in turn, is connected to an anchor. Alternatively, the orienting member is configured to land on an anchor in the parent wellbore below the slimhole region after the anchor has been set.

In one embodiment, the tool assembly further includes an upper tubular body. The upper tubular body has an inner diameter and an outer diameter, and an upper end and a lower end. In this embodiment, the outer diameter of the upper tubular body is also dimensioned to pass through the slimhole region. The top whipstock member resides along the inner diameter of the upper tubular body.

In yet another embodiment, the tool assembly further comprises a tubular deflection member. The deflection member has an inner diameter and an outer diameter, and an upper end and a lower end. The outer diameter of the deflection member is dimensioned to pass through the slimhole region. Further, the lower end of the deflection member is pivotally connected to the upper end of the upper tubular body by a top kick-over hinge. Preferably, the upper end of the deflection member has a beveled edge defining a face. The face is oriented away from the bottom tubular body when the bottom kick-over hinge is rotated from its first position to its second position. This directs the hose through the deflection member, along the wall of the casing opposite the point of desired casing exit, and down onto the unified bend radius below the slimhole region.

It is preferred that the upper end of the deflection member be expandable. In this embodiment, the deflection member may contain expandable members configured to expand below the slimhole region so as to deflect and direct the advancing jetting hose along a desired path. The upper end of the deflection member may be radially expanded to prevent the hose from bypassing the face when the system is run below the slimhole region and the hose is run into the wellbore against the unified bend radius. The deflection member may include a longitudinal channel to direct the hose onto the bend radius opposite the casing exit.

A method for forming a lateral wellbore from a parent wellbore is also provided herein. The parent wellbore has been completed with a string of production casing defining an inner diameter. In addition, the parent wellbore has a slimhole region defining an inner diameter that is less than the inner diameter of the production casing.

In one embodiment, the method includes providing a downhole tool assembly. The tool assembly is a jetting assembly in accordance with the assembly described above. The tool assembly includes a hose-bending section made up of one or more whipstock segments. The hose-bending section is designed to guide a jetting hose such that the bend radius of the jetting hose is equivalent to the full available I.D. of the production casing.

In one embodiment, the hose-bending section comprises a top whipstock member and a bottom whipstock member. Both the top whipstock member and the bottom whipstock member have a curved face.

The tool assembly also includes a hose-guiding section. The hose guiding section provides means for directing the jetting hose to the top of the whipstock member at a location opposite a window location. For example, the hose-guiding section may have a beveled upper face at an upper end and a longitudinal channel for receiving a jetting hose and directing to the whipstock. The upper end of the hose-guiding section may have member that is expandable to prevent the jetting hose from bypassing the channel. Alternatively, the hose-guiding section may have a plurality of deflection faces for guiding the hose.

The method also includes running the tool assembly through the slimhole region of the parent wellbore. Thereafter, a force is applied to the tool assembly to cause the bottom whipstock member to rotate from a first run-in position, to a second set position wherein the hose-bending section causes the jetting hose to traverse substantially across the inner diameter of the production casing below the slimhole region. The force may be a compressive or "set-down" force. Alternatively, the force may be a hydraulic force.

The force causes the whipstock to rotate from a run-in position where the whipstock is collapsed, to a set position where the whipstock traverses substantially across the inner diameter of the production casing. It is understood that "substantially" does not require wall-to-wall coverage, but merely facilitates the jetting hose bending across the full inner diameter of the casing.

In one embodiment, rotating the whipstock member means rotating a bottom whipstock member to abut with a top whipstock member. The result is that the curved face of the top whipstock member and the curved face of the bottom whipstock member meet to form a unified bend radius. The radius takes advantage of the full inner diameter of the production casing. This, in turn, allows for a more robust hose carrying greater burst strength and a corresponding higher hydraulic pressure rating to accommodate a greater Power Output.

The method further includes running the hose into the parent wellbore. The hose is also run down to and against the unified bend radius within the production casing. In addition, the method includes injecting hydraulic fluid through the hose. In one embodiment, hydraulic fluid is used to actually create an opening in the production casing. Alternatively, an initial window is milled into the casing using a milling tool and milling bit at the end of the hose, and then removing the milling tool and milling bit and attaching a suitable jetting nozzle for jetting.

The method also includes further running the hose into the wellbore while injecting hydraulic fluid through the hose. This serves to create the lateral wellbore. In one aspect, the lateral wellbore is about 10 feet to 500 feet from the parent wellbore.

Preferably, the curved face of the whipstock member(s) are configured to receive the hose and redirect the hose about 90 degrees. This may allow a lateral wellbore to be formed that is perpendicular to the orientation of the wellbore. Where the parent wellbore is completed vertically, the lateral wellbore will be formed horizontally.

In one embodiment, the tool assembly also includes a bottom kick-over member below the bottom whipstock member, and a bottom kick-over hinge. The bottom kick-over member has an inner diameter and an upper end and a lower end. The bottom kick-over hinge is pivotally connected to the lower end of the bottom kick-over member. The bottom kick-over hinge allows the kick-over member to translate from a first position aligned with a major axis of the bottom whipstock member in its run-in position, to a second position against an inner wall of the production casing in response to the compressive force.

In one aspect, the method further comprises setting an anchor within the production casing of the parent wellbore. The anchor is set below the slimhole region.

It is preferred that the bottom kick-over hinge be pivotally connected to an orienting member. The orienting member is connected to the anchor. The method then further comprises setting the anchor within the production casing of the parent wellbore below the slimhole region.

In one embodiment, the method further includes discontinuing injecting hydraulic fluid through the hose, pulling the hose out of the lateral wellbore, actuating the orienting member to rotate the device a selected number of degrees, and running the hose into the wellbore while injecting hydraulic fluid through the hose to create a second lateral wellbore.

In any of the above methods, the device may also include an upper tubular body having an inner diameter and an outer diameter, and an upper end and a lower end. The outer diameter of the upper tubular body is dimensioned to pass through the slimhole region. The top whipstock member resides along the inner diameter of the upper tubular body.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 3A is a side view of the jetting assembly set within a vertical wellbore. The assembly is in an operating position, with a jetting hose run into the wellbore.

FIG. 3B is a top view of the jetting assembly of FIG. 3A, shown across line B-B of FIG. 3A.

FIG. 3C is a perspective view of the jetting assembly of FIG. 3A. Here, a fuller view of the wellbore is seen. The jetting assembly is being run through production tubing residing concentrically within a string of production casing. The production tubing represents a "slimhole" region.

FIG. 3D is another perspective view of the jetting assembly of FIG. 3A. Here, the jetting assembly has cleared the production tubing and has been set within the string of production casing adjacent a target producing formation. A jetting nozzle has penetrated through the production casing exit and an annular cement sheath, and is beginning to jet a lateral borehole into the surrounding formation or "pay zone."

FIG. 4A presents a perspective view of the downhole jetting assembly in its run-in position. Here, the assembly is descending down a string of production tubing. The production tubing represents a "slimhole" region within production casing.

FIG. 4B is a cross-sectional view of the jetting assembly of FIG. 4A. The upper portion of the production casing and production tubing have been removed for greater clarity. The production tubing still resides concentrically within the production casing.

FIG. 4C is another perspective view of the jetting assembly of FIG. 4A. Here, the jetting assembly has cleared the production tubing and has been set within the string of production casing adjacent a target producing formation. A jetting nozzle has penetrated through the production casing exit and an annular cement sheath, and is beginning to jet a lateral borehole into the formation.

FIG. 5A is a side schematic view of the anchor section of the jetting assembly. Here, the anchor section is set within a production casing, shown schematically.

FIG. 5B is a perspective view of the anchor section of the jetting assembly. Here, the anchor section is in its run-in position, and is being moved through a string of production tubing. The production tubing resides concentrically within a production casing.

FIG. 5C is another perspective view of the anchor section of FIG. 5A. The anchor section has cleared the production tubing, and is now set within the production casing.

FIG. 6A is a side view of the orienting section of the jetting assembly. Here, the orienting section is seen above and attached to the anchor section, with the anchor section being set within a production casing, shown schematically.

FIG. 6B is a perspective view of the orienting section of the jetting assembly. Here, the orienting section is in its run-in position, and is being moved through a string of production tubing. The production tubing resides concentrically within a production casing.

FIG. 6C is another perspective view of the orienting section of the jetting assembly. The orienting section has cleared the production tubing, and is now set within the production casing above the anchor section.

FIG. 7A is a side view of the hose-bending section of the jetting assembly. Here, the hose-bending section is set and is in operating position. The hose-bending section is within a production casing, shown schematically.

FIG. 7B is a perspective view of the hose-bending section of the jetting assembly. Here, the hose-bending section is in its run-in position, and is being moved through a string of production tubing. The production tubing resides concentrically within a production casing.

FIG. 7C is another perspective view of the hose-bending section of the jetting assembly. The hose-bending section has cleared the production tubing, and has received a jetting hose. The jetting hose has created an opening in the production casing, and is moving into the formation to form a mini-lateral.

FIG. 8A is a side view of the hose guiding section of the jetting assembly, in one embodiment. Here, the hose guiding section is set and is in operating position. The hose-guiding section is within a production casing, shown schematically.

FIG. 8B is a perspective view of the hose-guiding section of the jetting assembly. Here, the hose-guiding section is in its run-in position, and is being moved through a string of production tubing. The production tubing resides concentrically within a production casing.

FIG. 8C is a cross-sectional view of the hose-guiding section of FIG. 8A. Portions of the production casing and production tubing are removed for clarity.

FIG. 8D is another perspective view of the hose-guiding section of the jetting assembly. The hose-guiding section has cleared the production tubing, and is now receiving a jetting hose. The hose-guiding section is in operating position.

DETAILED DESCRIPTION OF CERTAIN EMBODIMENTS

Definitions

Figure 1A:
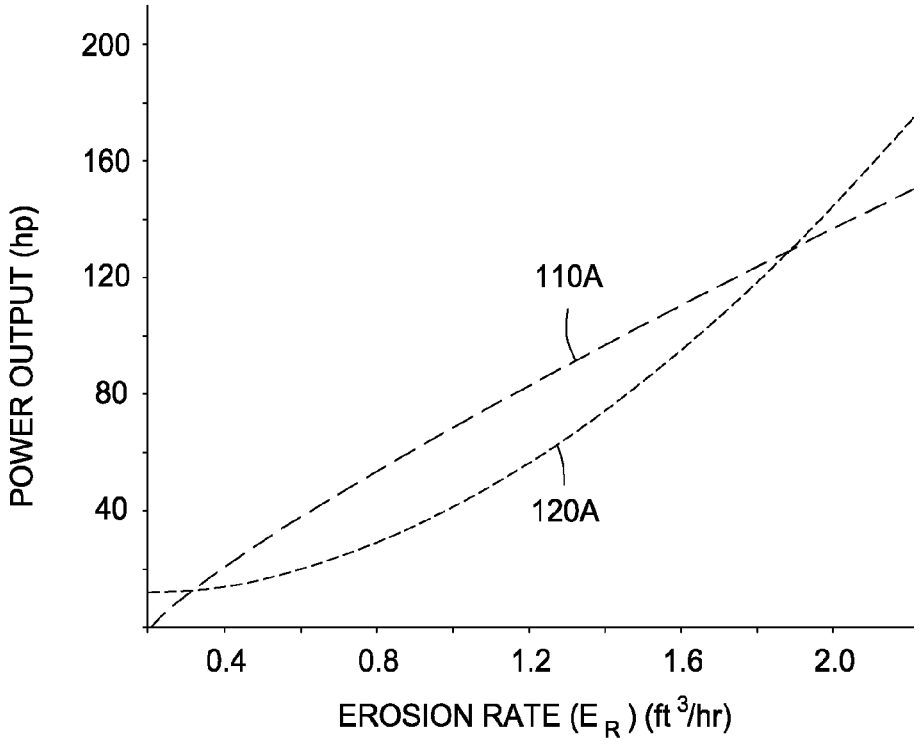
FIG. 1A is a Cartesian coordinate plotting Power Output as a function of Erosion Rate in a hydraulic jetting test. This figure is based upon test results using a Darley Dale Sandstone.
Figure 1B:
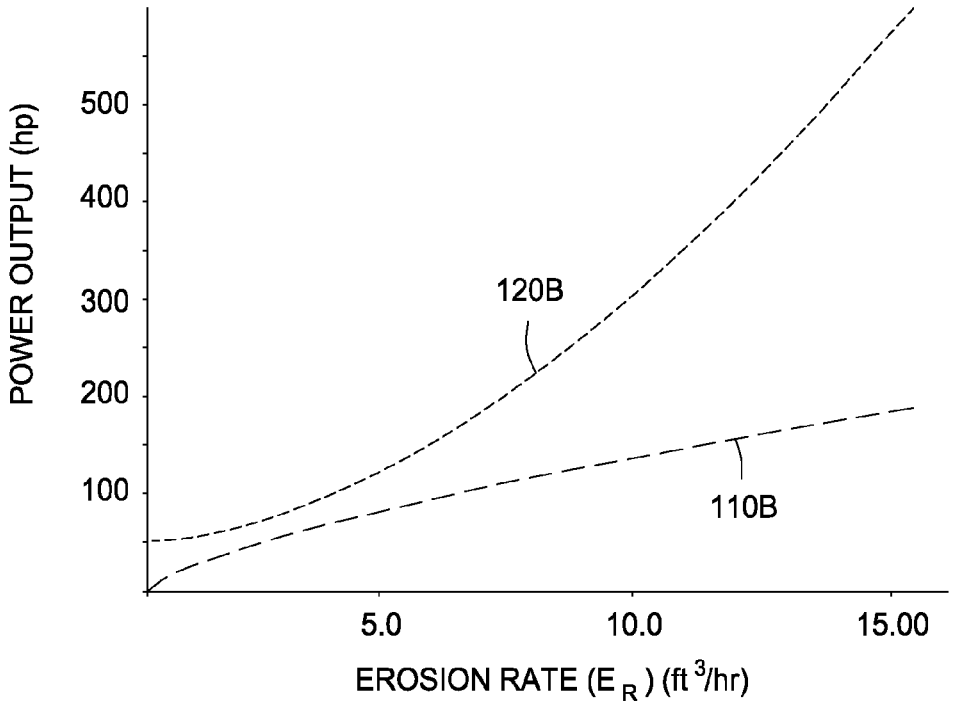
FIG. 1B is another Cartesian coordinate plotting Power Output as a function of Erosion Rate in a hydraulic jetting test. This figure is based upon test results using a Berea Sandstone.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "condensable hydrocarbons" means those hydrocarbons that condense at about 15° C. and one atmosphere absolute pressure. Condensable hydrocarbons may include, for example, a mixture of hydrocarbons having carbon numbers greater than 4.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The term "jetting fluid" refers to any fluid pumped through a jetting hose and nozzle assembly (typically at extremely high pressures) for the purpose of erosionally boring a lateral borehole from an existing parent wellbore. The jetting fluid may or may not contain an abrasive material.

The term "abrasive material" refers to small, solid particles mixed with or suspended in the jetting fluid to enhance erosional penetration of: (1) the pay zone; and/or (2) the cement sheath between the production casing and pay zone; and/or (3) the wall of the production casing at the point of desired casing exit.

The terms "tubular" or "tubular member" refer to any pipe, such as a joint of casing, a portion of a liner, a joint of tubing, or a pup joint.

Description of Specific Embodiments

Figure 2:
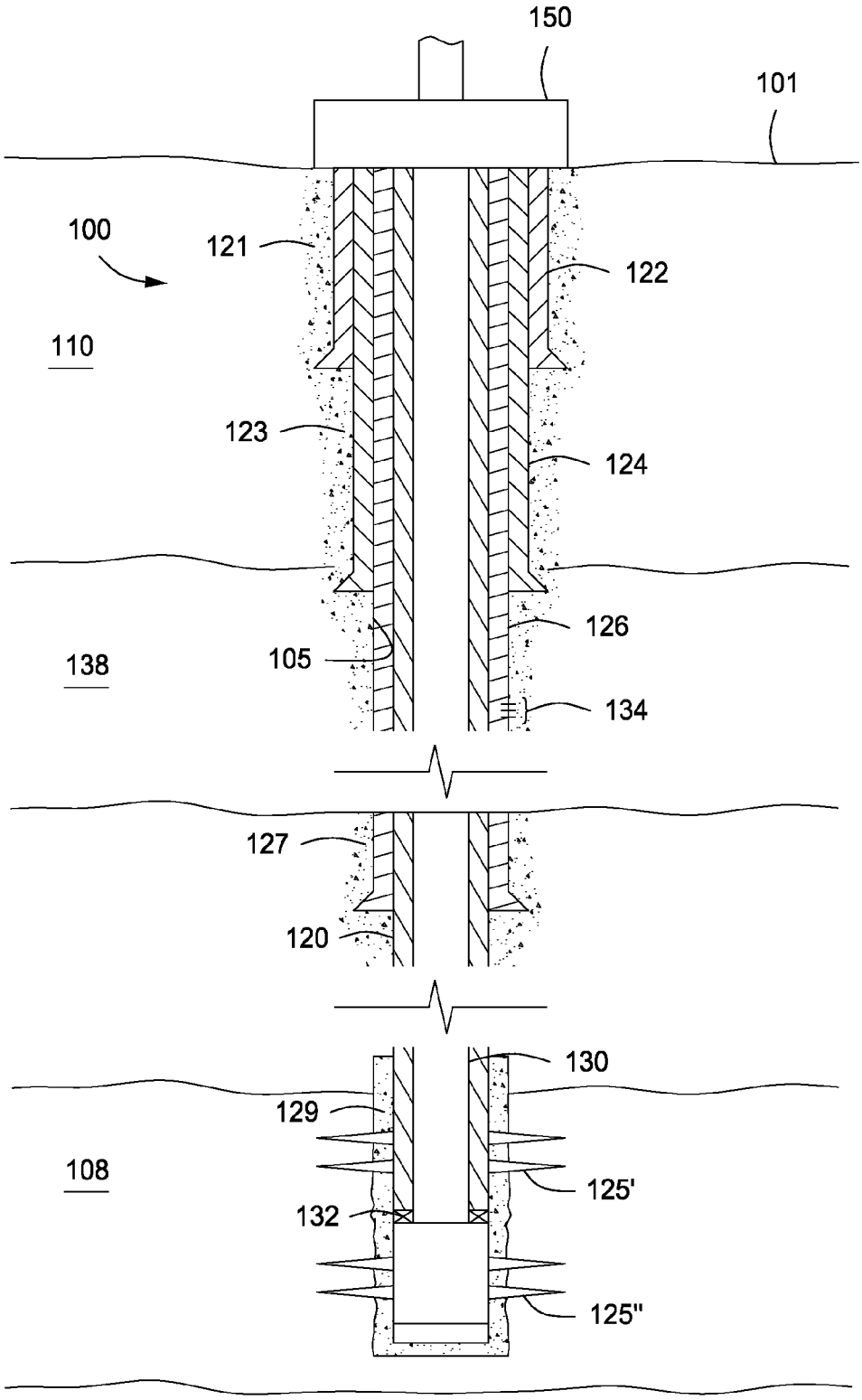
FIG. 2 is a side view of an illustrative wellbore. The wellbore has a slimhole region.

FIG. 2 is a cross-sectional view of an illustrative wellbore 100. The wellbore 100 defines a bore 105 that extends from a surface 101, and into the earth's subsurface 110. The wellbore 100 is completed with a string of production casing 120 that spans the length of the wellbore 100. The production casing 120 is perforated along a target producing formation 108. Perforations are seen at 125 to provide fluid communication between the producing formation 108 and the bore 105.

The wellbore 100 has been formed for the purpose of producing hydrocarbons for commercial sale. A string of production tubing 130 is provided in the bore 105 to transport production fluids from the producing formation 108 up to the surface 101. The wellbore 100 may optionally have a pump (not shown) along the producing formation 108 to artificially lift production fluids up to the surface 101.

The wellbore 100 has been completed by setting a series of pipes into the subsurface 110. These pipes include a first string of casing 122, sometimes known as conductor pipe. These pipes also include a second string of casing 124. The second string of casing 124, sometimes known as surface casing, has the primary purpose of isolating the wellbore 100 from any potential fresh water strata. Hence, casing strings 122 and 124 are typically required to be cemented completely back to surface 101. FIG. 2 shows cement sheaths 121 and 123 around casing strings 122 and 124, respectively. In addition, cement sheath 129 protects at least a part of the production casing 120.

Possibly a third 126 or more strings of casing, sometimes known as intermediate pipe, may be required to safely and/or efficiently drill the wellbore to total depth by providing support for walls of the wellbore 100. Cement sheath 127 covers at least a part of the intermediate casing string 126. Note that cement columns 127, 129 do not extend to the surface 101, as is common for these casing strings, particularly in deeper wellbores.

Intermediate casing string 126 may be hung from the surface 101, or may be hung from a next higher casing string 124 using special downhole devices, such as a liner hanger. It is understood that a pipe string that does not extend back to the surface (not shown) is normally referred to as a "liner." In the illustrative arrangement of FIG. 2, intermediate casing string 126 is hung from the surface 101, while casing string 120 is hung from a lower end of casing string 126. Additional intermediate casing strings (not shown) may be employed. The present inventions are not limited to the type of completion casing arrangement used.

Each string of casing 122, 124, 126, and the production tubing string 130, is connected to, sealed, and isolated by various valves and fittings comprising a wellhead 150. The wellhead 150 is located immediately above and/or slightly below the surface 101. Immediately atop, and connected to the wellhead 150, is a well tree (not shown). The well tree is comprised of various valves and possibly a choke capable of limiting, completely shutting in, and/or redirecting flow from the wellbore 100.

In the wellbore 100 of FIG. 2, two different sets of perforations 125 have been created. These represent an upper set of perforations 125', and a lower set of perforations 125". Each set of perforations 125', 125" may correlate to a separate pay zone within the producing formation 108. The pay zone associated with the higher set of perforations 125' may be partially depleted.

In FIG. 2, the wellbore 100 has a slimhole region. Here, the slimhole region is the string of production tubing 130, which runs from the surface 101 (specifically a tubing hanger) down to a downhole packer 132. However, the slimhole region may alternatively be a straddle packer used for isolating a previously completed subsurface zone. Alternatively still, the slimhole region may be a string of repair casing used to isolate an area of the wellbore where the casing has become corroded or otherwise compromised.

Note the inner diameters of both the production tubing 130 and packer 132 may be equal, or nearly so; but both will be significantly less than the inner diameter of production casing 120.

The downhole packer 132 serves to anchor the tubing string 130, and to isolate the pressures and flows of fluids through the lower set of perforations 125" from an annular region between the production casing 120 and the production tubing 130. In addition, within FIG. 2, the packer's 132 isolation prevents cross-flow of fluids between the lower 125' and the higher 125" sets of perforations. In addition, the packer 132 isolates production fluids from the lower set of perforations 125" from casing leaks 134. Such casing leaks 134 may be induced, for example, by corrosive brine from a higher formation 138. These leaks 134 provided a path for old drilling mud from the annular region between production casing 130 and borehole 105 (which was only partially displaced by cement 129) to invade perforations 125' and damage the higher pay zone, leading to its premature abandonment.

The operator of wellbore 100 may desire to stimulate the subsurface formation 108 to increase the production of valuable hydrocarbons. Specifically, the operator may desire to stimulate the producing formation 108 by forming a series of small, radial, boreholes through the production casing 120 and outward into the formation 108. Accordingly, a system for controllably forming lateral boreholes from a parent wellbore is provided herein. The lateral boreholes are formed using hydraulic forces that are directed through a jetting hose. Beneficially, the system allows the operator to complete a vertical-to-horizontal transition within a well casing, exit the casing, and subsequently jet horizontal lateral boreholes using the entire casing inner diameter ("ID") as the bend radius for the jetting hose.

Using the full I.D. of the production casing (that is, below the production tubing 130) allows the operator to use a jetting hose having a larger diameter. This, in turn, allows the operator to pump a higher volume of jetting fluid, thereby generating higher hydraulic horsepower at the jetting nozzle at a given pump pressure. This will provide for substantially more P.O. at the jetting nozzle; that is, the nozzle at the end of the jetting hose. These P.O. benefits will enable:

(1) jetting larger diameter lateral boreholes within the target formation;
(2) achieving longer lateral lengths;
(3) achieving greater erosional penetration rates; and/or
(4) achieving erosional penetration of higher ($\sigma_M$) and ($P_{Th}$) oil/gas reservoirs heretofore considered impenetrable by existing hydraulic jetting technology. This, in general, will facilitate targeting deeper reservoirs than previously believed erosionally penetrable.

Because of open perforations 125" to a partially depleted pay zone, and because of casing leaks 134 providing an open path for the corrosive brines of formation 138, removal of packer 132 in order to perform the stimulation could induce cross-flow (with associated well control issues) and/or formation damage to the pay zone associated with the lower perforations 125". Accordingly, the operator should not consider any stimulation technique that requires removal of the packer 132. This represents a viable scenario played out numerous times in wells completed through corrosive strata, such as wells in the panhandles of Texas and Oklahoma completed through the Brown Dolomite formation.

Even if packer 132 was, by design, retrievable, it is more than likely trapped within the wellbore 100 by accumulated debris atop it from casing leak 134. Thus, even if cross-flow or formation damage were not factors, the mere expense to 'wash over' the debris and retrieve the packer 132 could far outweigh the perceived benefit of stimulating the pay zone adjacent lower perforations 125". Further, even in the absence of a casing failure or the upper perforations 125', there could be a risk of formation damage to 'kill' the well. Absent such formation damage risk, the operator would certainly desire to forego the expense of killing the well, and pulling and reinstalling production tubing 130, if at all possible. Hence, in virtually any wellbore configuration scenario, if two stimulation techniques provide relatively equal production enhancement at similar service costs, and have relatively equal chances of success, and one of them can be performed "through tubing" (i.e., does not require removal of packer 132 and/or tubing string 130), the through-tubing alternative will be the least total cost alternative, and therefore the preferred alternative. Note, however, in some wellbore situations, such as those depicted in FIG. 2, the through-tubing alternative may be the only viable alternative.

FIGS. 3A through 3D illustrate a downhole hydraulic jetting assembly 200 of the present invention, in one embodiment.

Figure 3A:
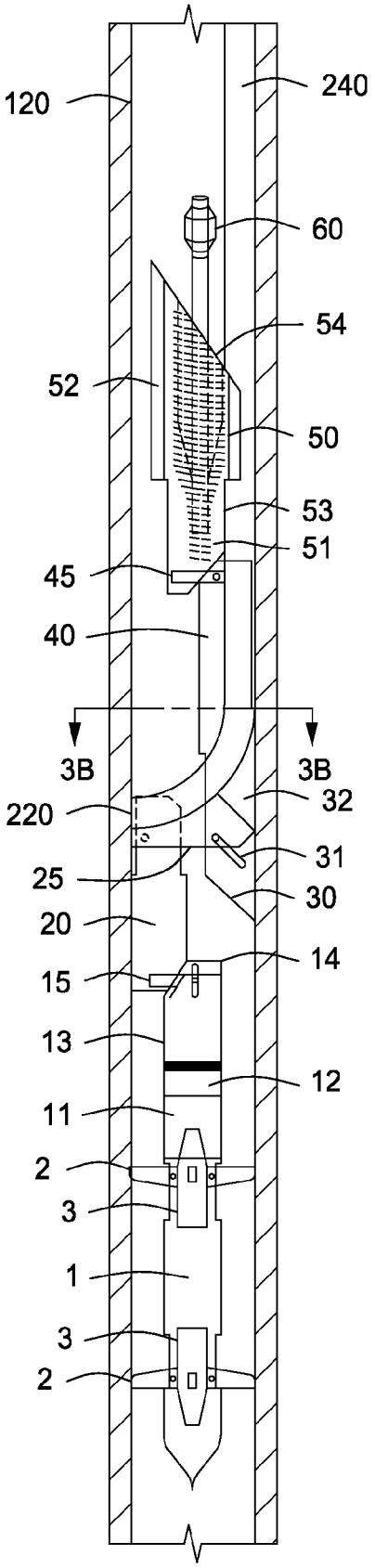
FIGS. 3A through 3D illustrate a downhole hydraulic jetting assembly of the present invention, in one embodiment.

FIG. 3A is a two-dimensional (2-D) side view of the jetting assembly 200 set within a vertical wellbore 210. The assembly 200 is in an operating position, with a jetting hose 240 run into the wellbore 210. More specifically, the assembly 200 is inside a string of production casing 120. The production casing 120 may have, for example, a 4.5-inch OD (4.0-inch ID).

Figure 3B:
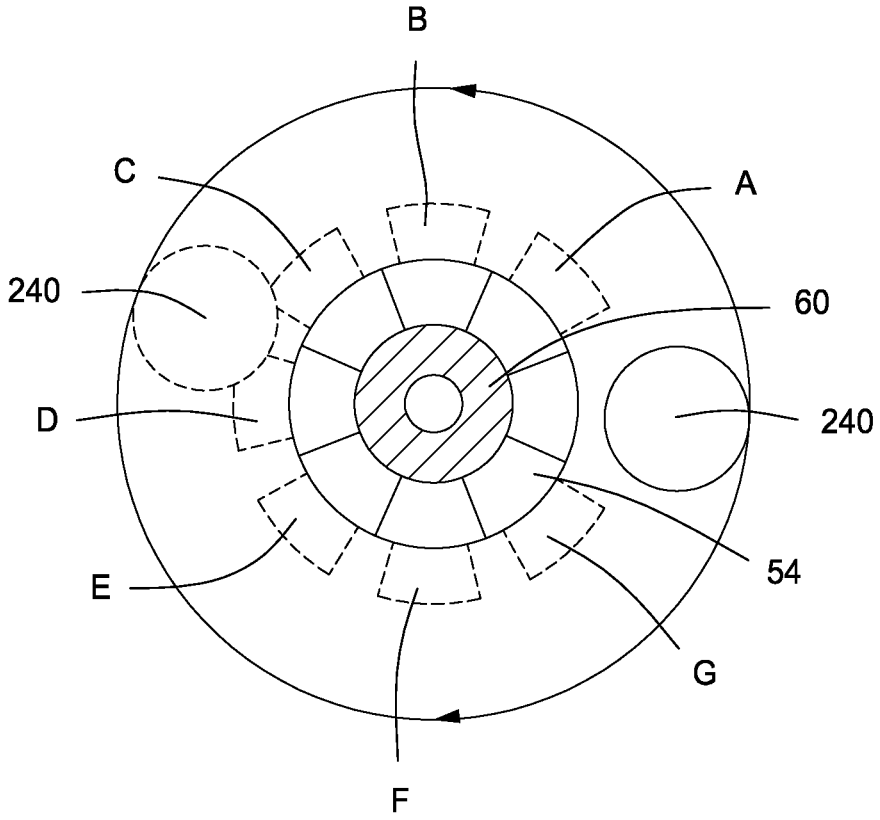

FIG. 3B is a top view of the jetting assembly 200 of FIG. 3A, shown across line B-B of FIG. 3A. In FIG. 3B, equi-radial sections "A," "B," "C," "D," "E," "F," and "G" are formed into the assembly 200.

Figure 3C:
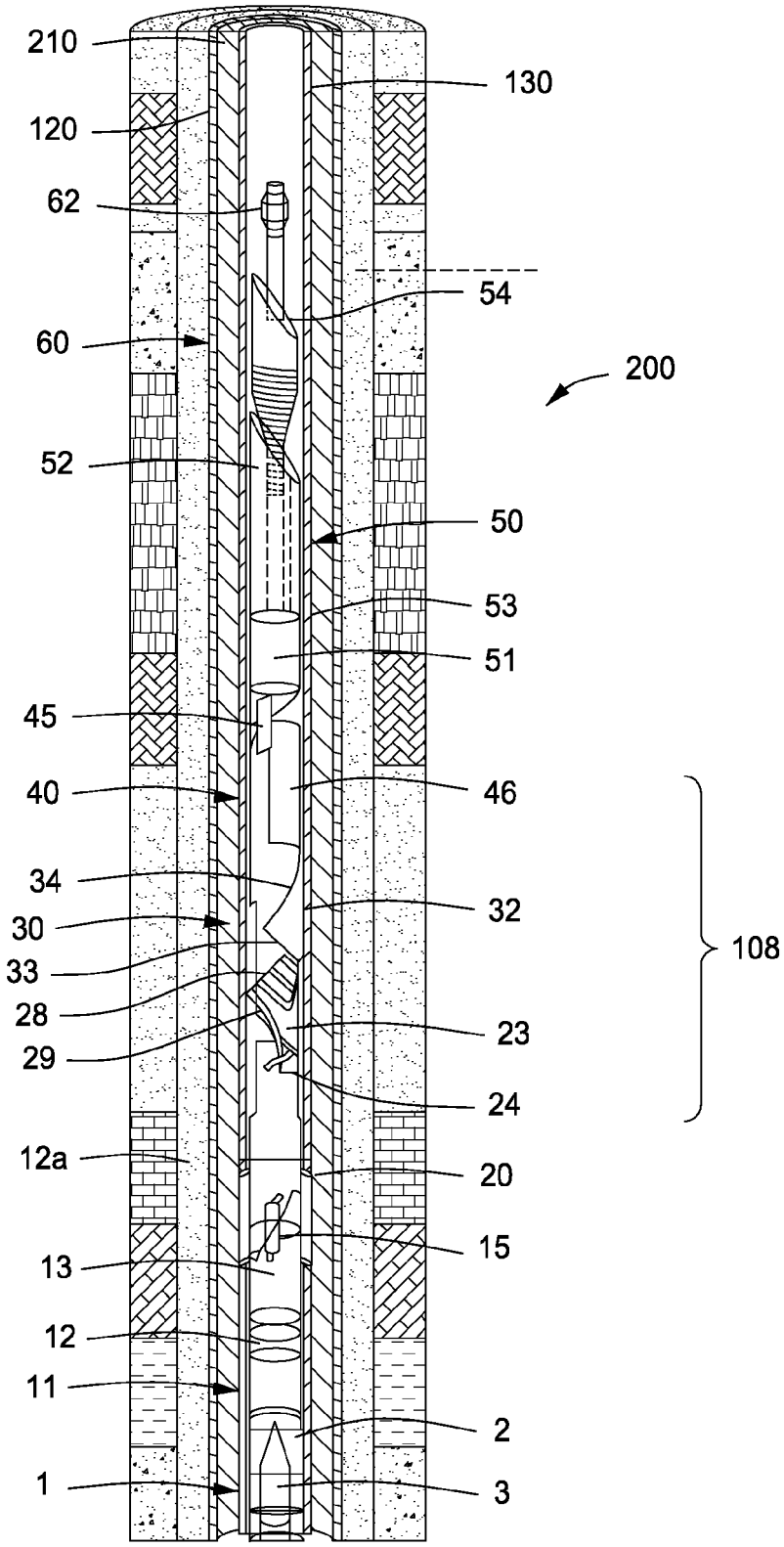

FIG. 3C is a perspective view of the jetting assembly 200 of FIG. 3A. Here, a fuller view of the wellbore 210 is seen. The jetting assembly 200 is being run through production tubing 130 residing concentrically within the string of production casing 120. The production tubing 130 represents a "slimhole" region. In one aspect, the production tubing 130 is a string of 2.375-inch OD (1.995-inch ID) production tubing.

When collapsed and in its running position (e.g., for running into and retrieving out of the wellbore 210), the entire assembly 200 (when designed for application in a 4.5-inch O.D.) production casing, has a maximum outer diameter of about 1.75-inches. Consequently, the assembly 200 can be conveyed and withdrawn through 2⅜-inch conventional production tubing (I.D.=1.995-inch). Of course, the assembly 200 could be constructed for setting and operation in other production casing 120 (or, production liner) sizes, and for conveyance through other tubing 130 (and other slimhole restriction) sizes.

Figure 3D:
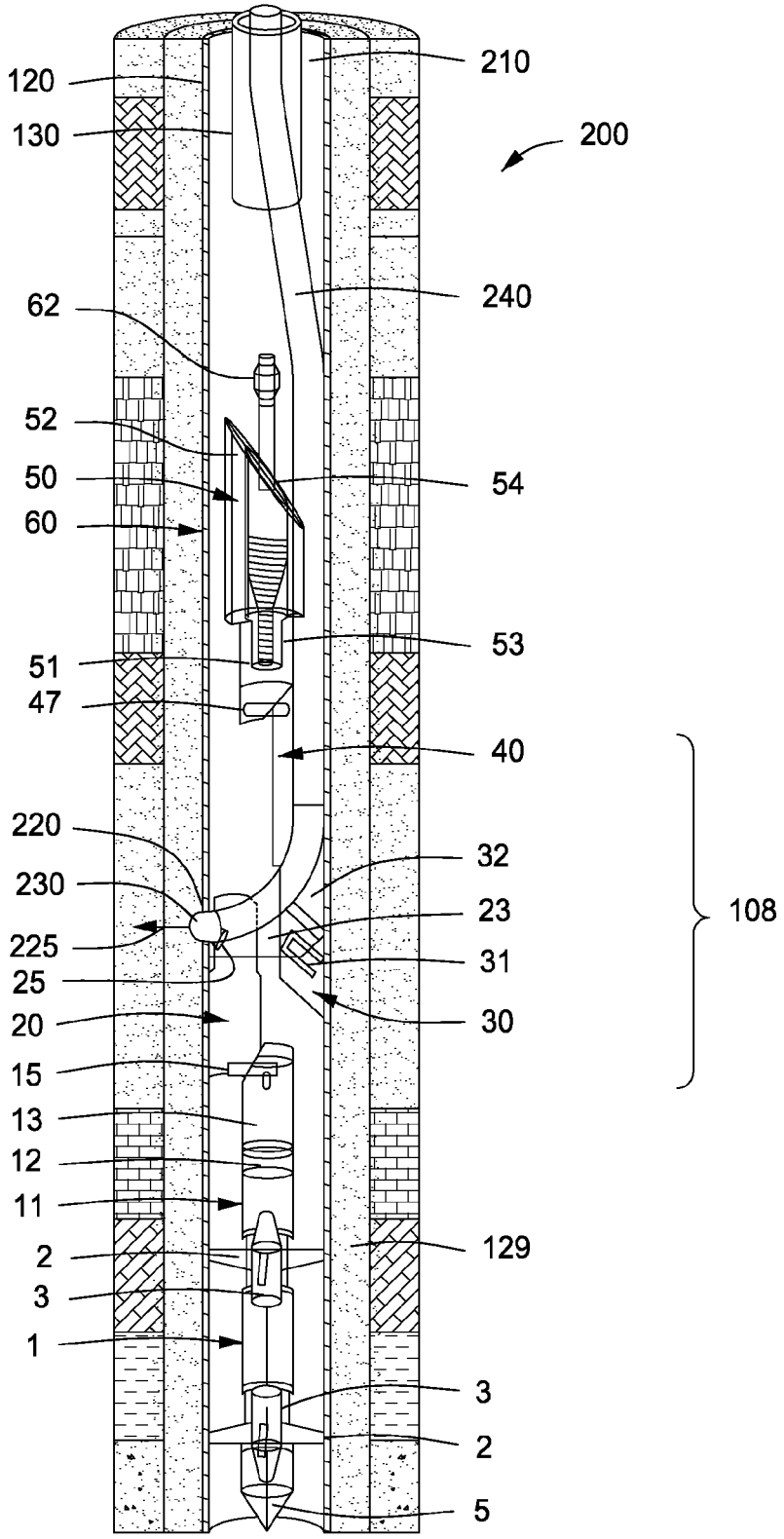

FIG. 3D is another perspective view of the jetting assembly 200 of FIG. 2A. Here, the jetting assembly 200 has cleared the production tubing 130 and has been set within the string of production casing 120 adjacent a target producing formation 108. A jetting nozzle 230 has penetrated through a production casing exit 220 and an annular cement sheath 129, and is beginning to jet a lateral borehole 225 into the formation 108.

Figure 4A:
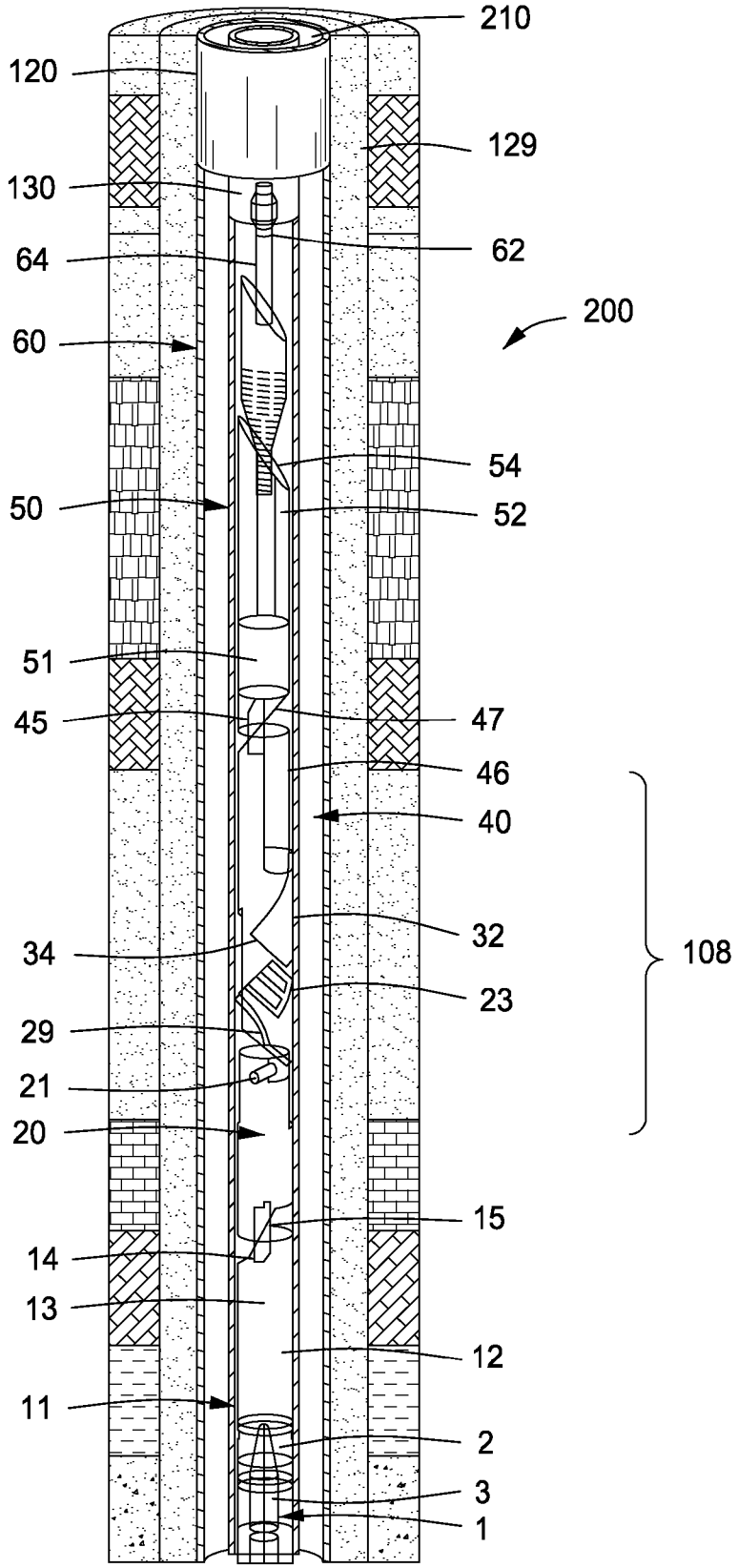
FIGS. 4A through 4C illustrate the downhole hydraulic jetting assembly of the present invention, in other views. The jetting assembly is within a wellbore that has been completed through multiple geologic formations.
Figure 4B:
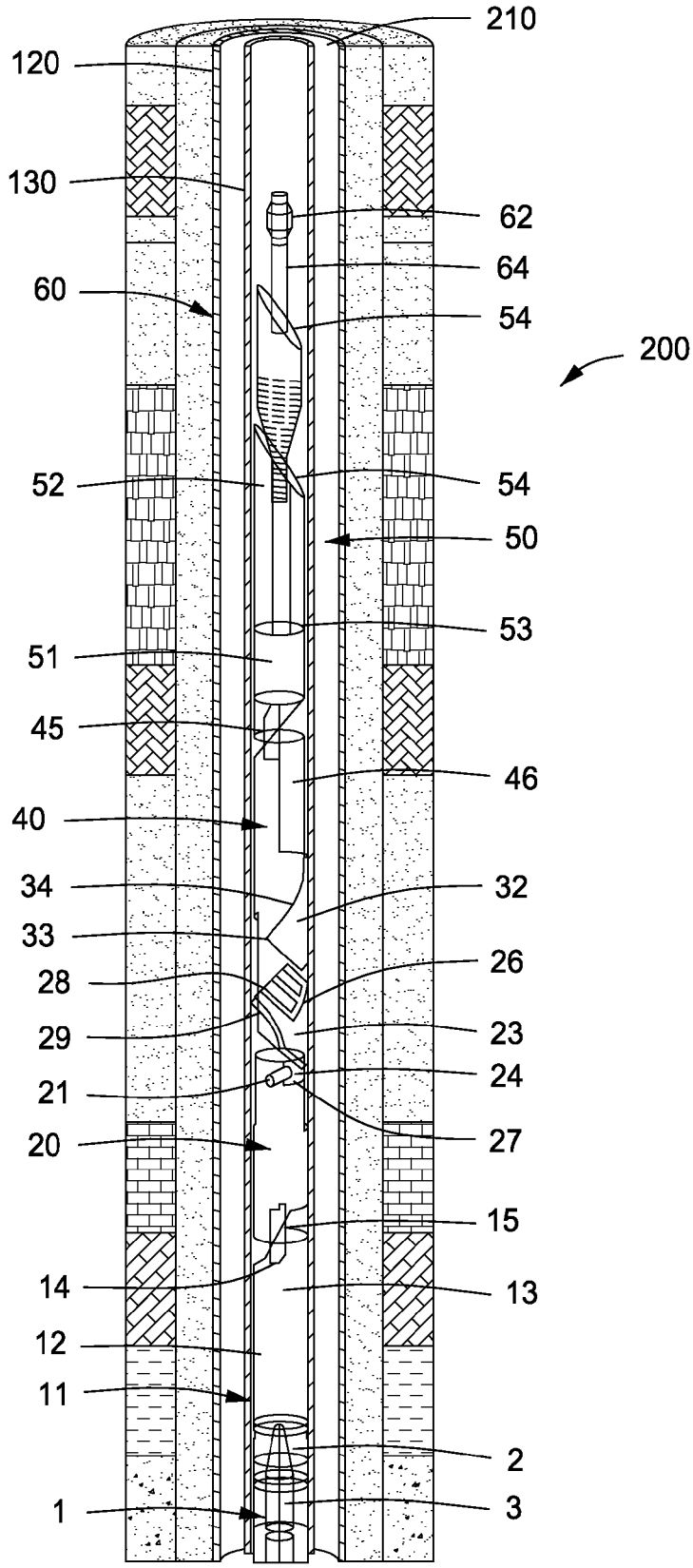
Figure 4C:
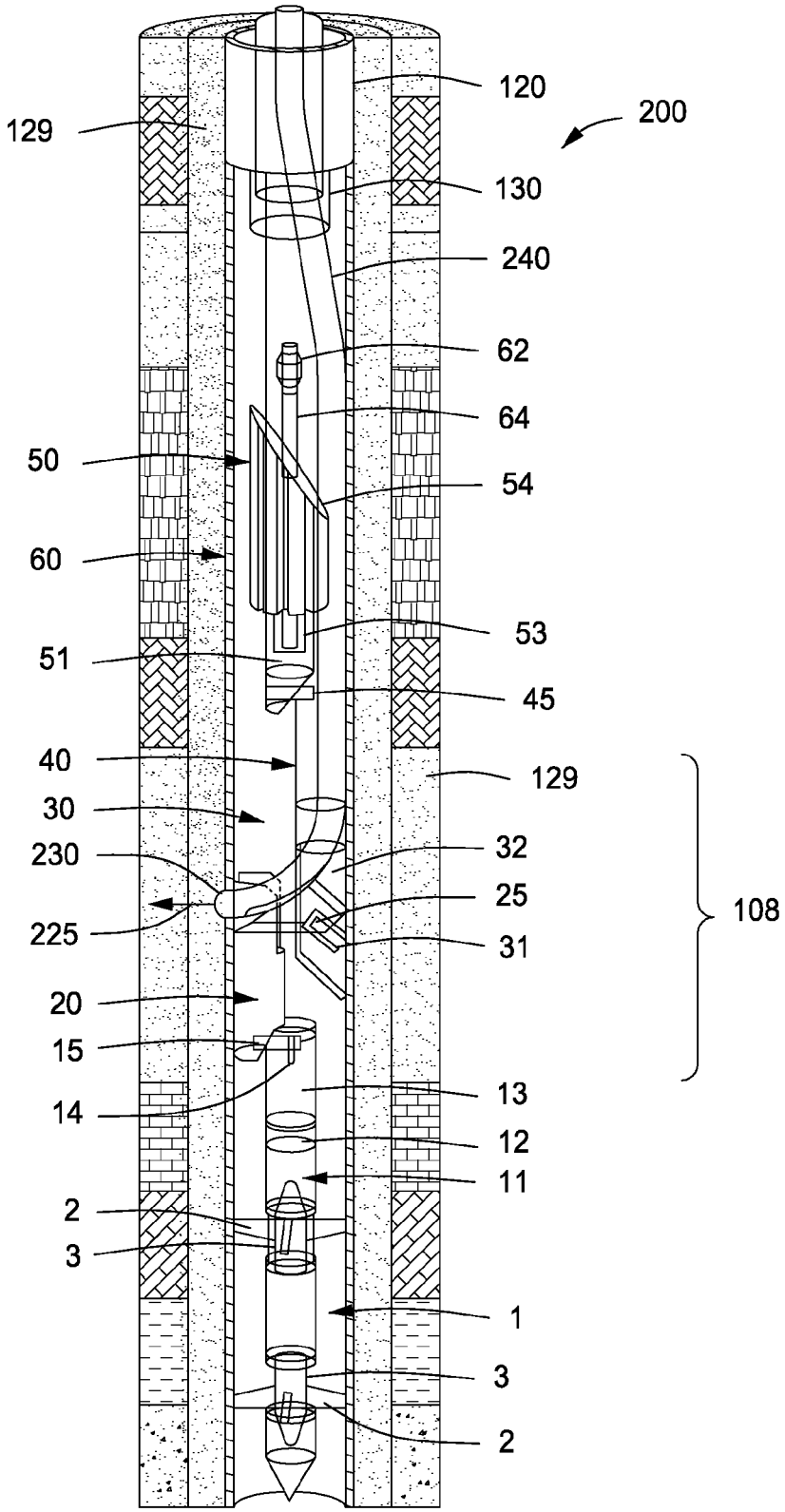
Figure 5A:
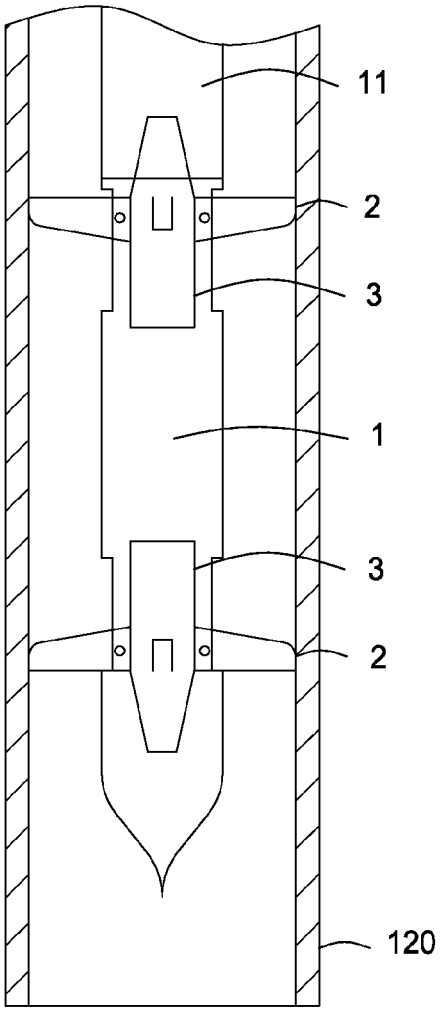
FIGS. 5A through 5C present an enlarged portion of the downhole hydraulic jetting assembly of FIGS. 3A through 3D. In these views, the anchor section of the jetting assembly is seen within a wellbore.
Figure 6A:
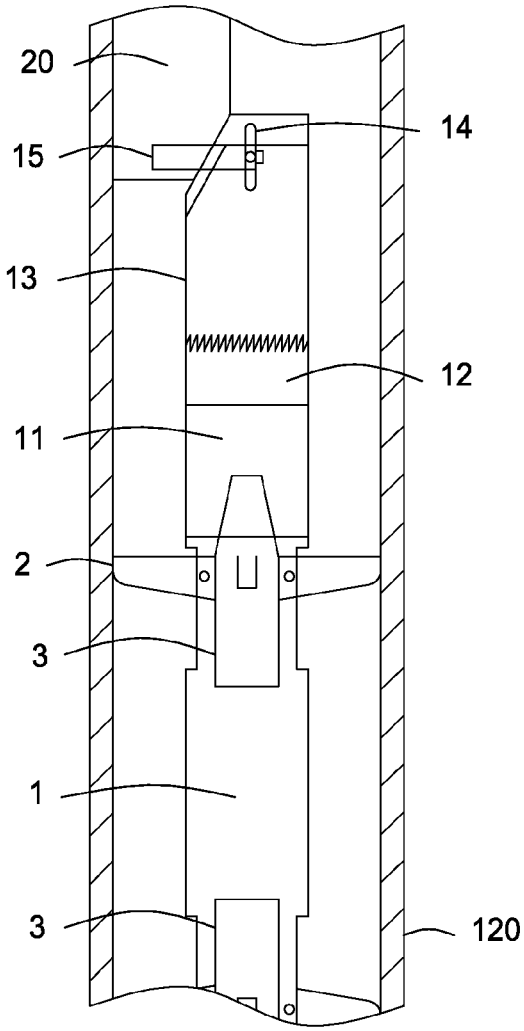
FIGS. 6A through 6C present another series of an enlarged portion of the downhole hydraulic jetting assembly of FIGS. 3A through 3D. In these views, the orienting section of the jetting assembly is seen within a wellbore.
Figure 5B:
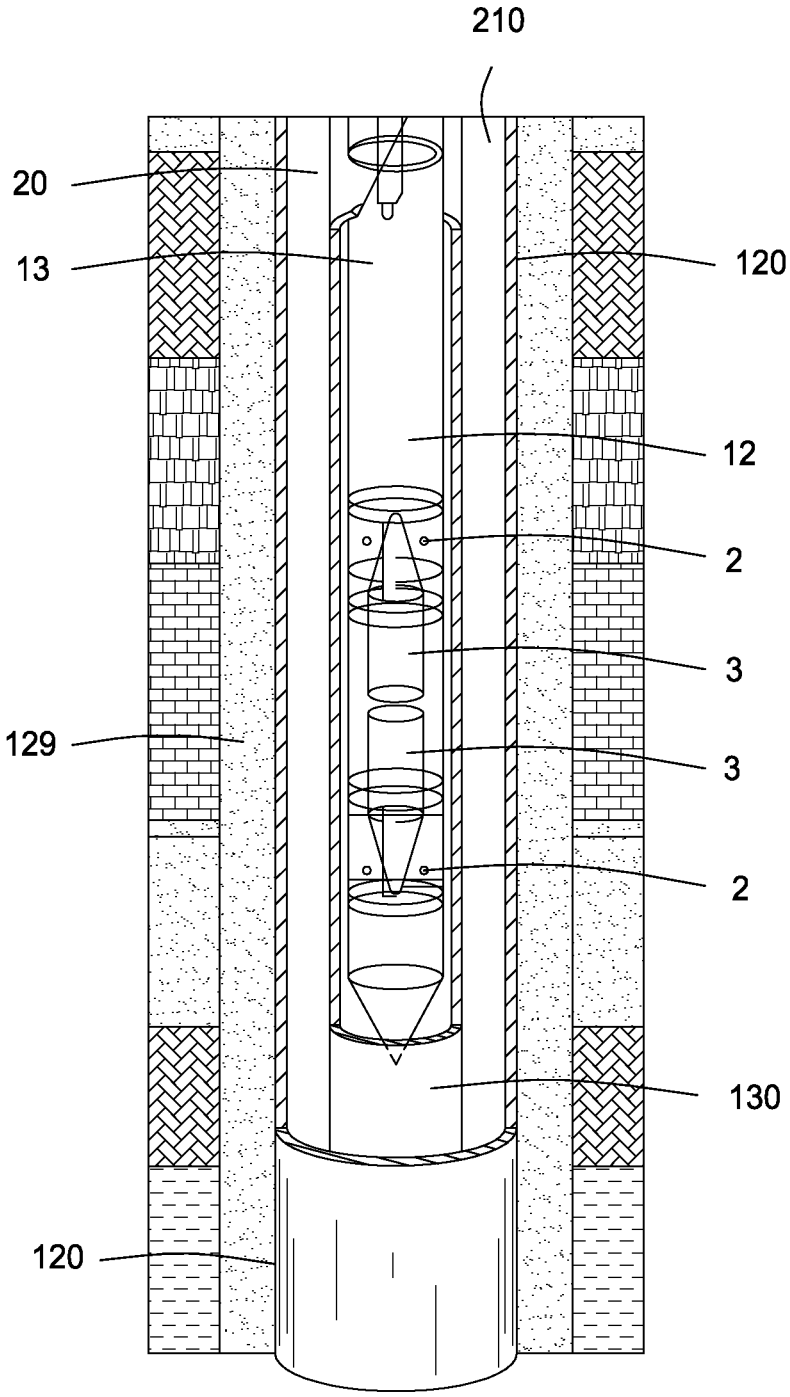
Figure 5C:
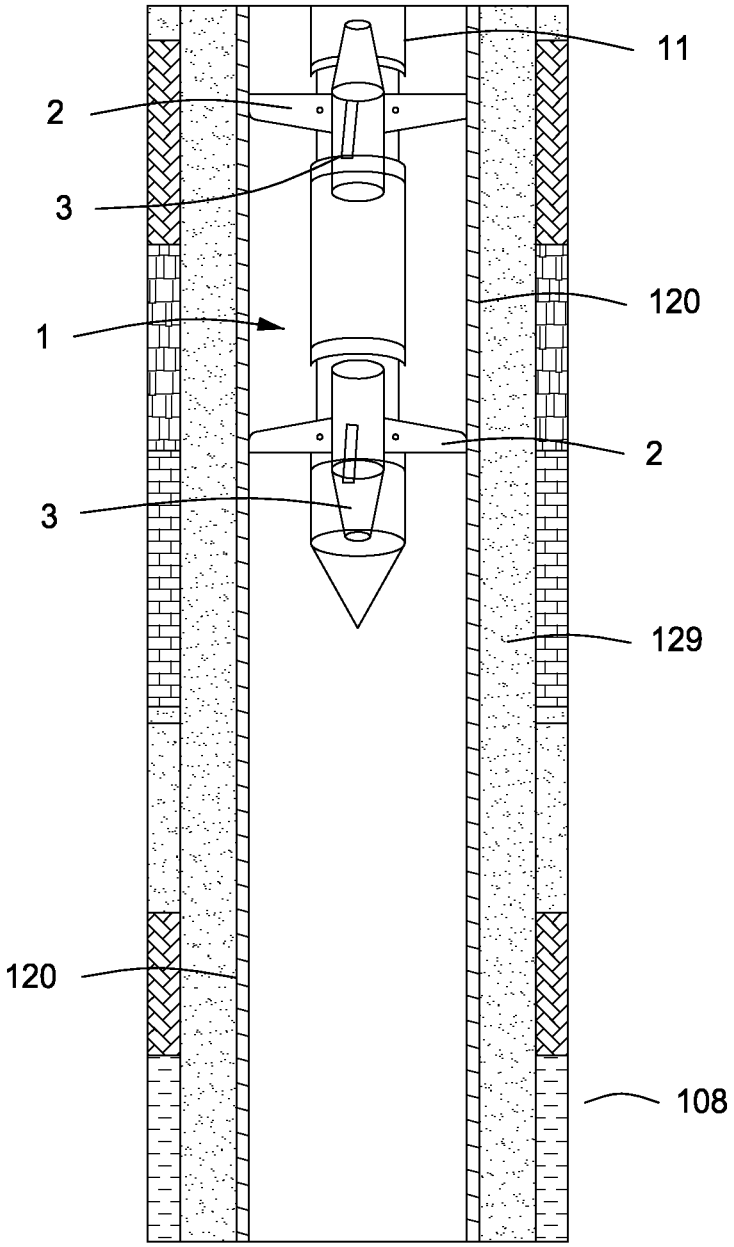
Figure 6B:
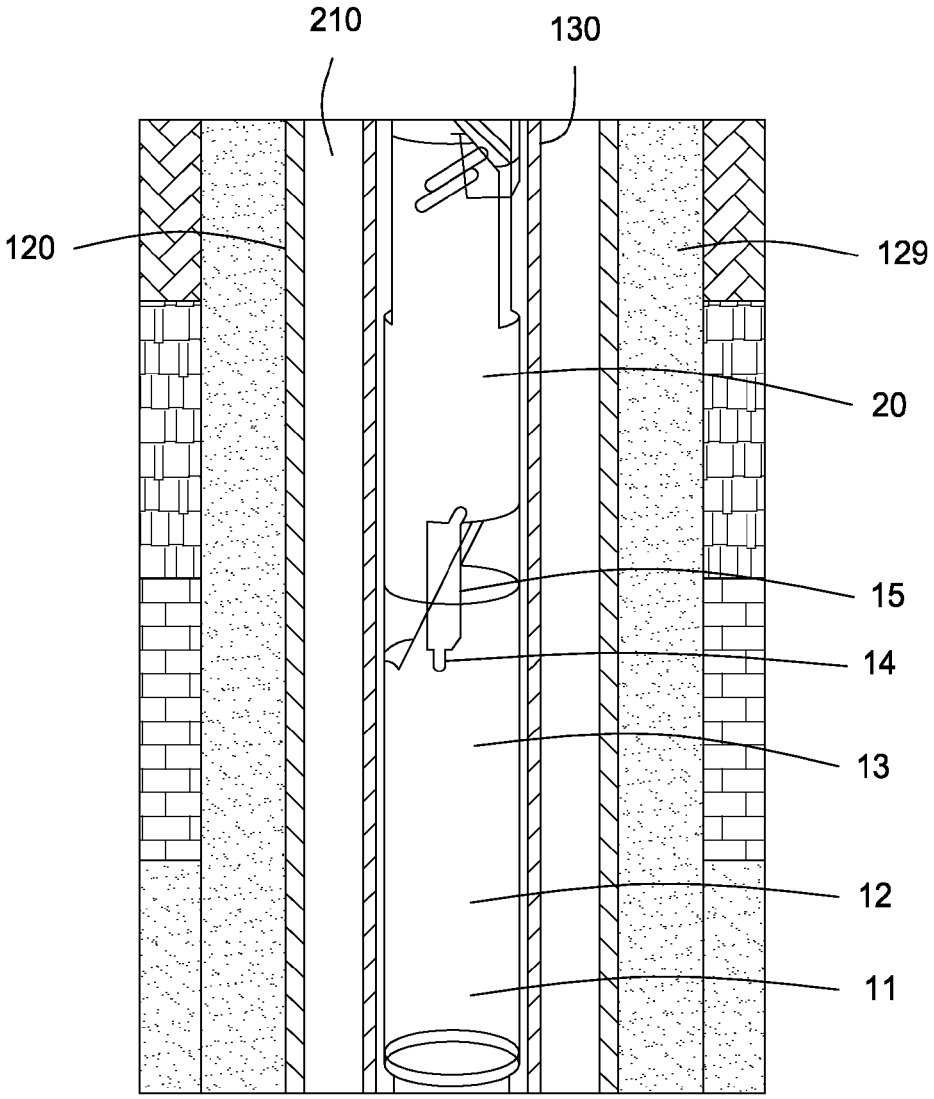
Figure 6C:
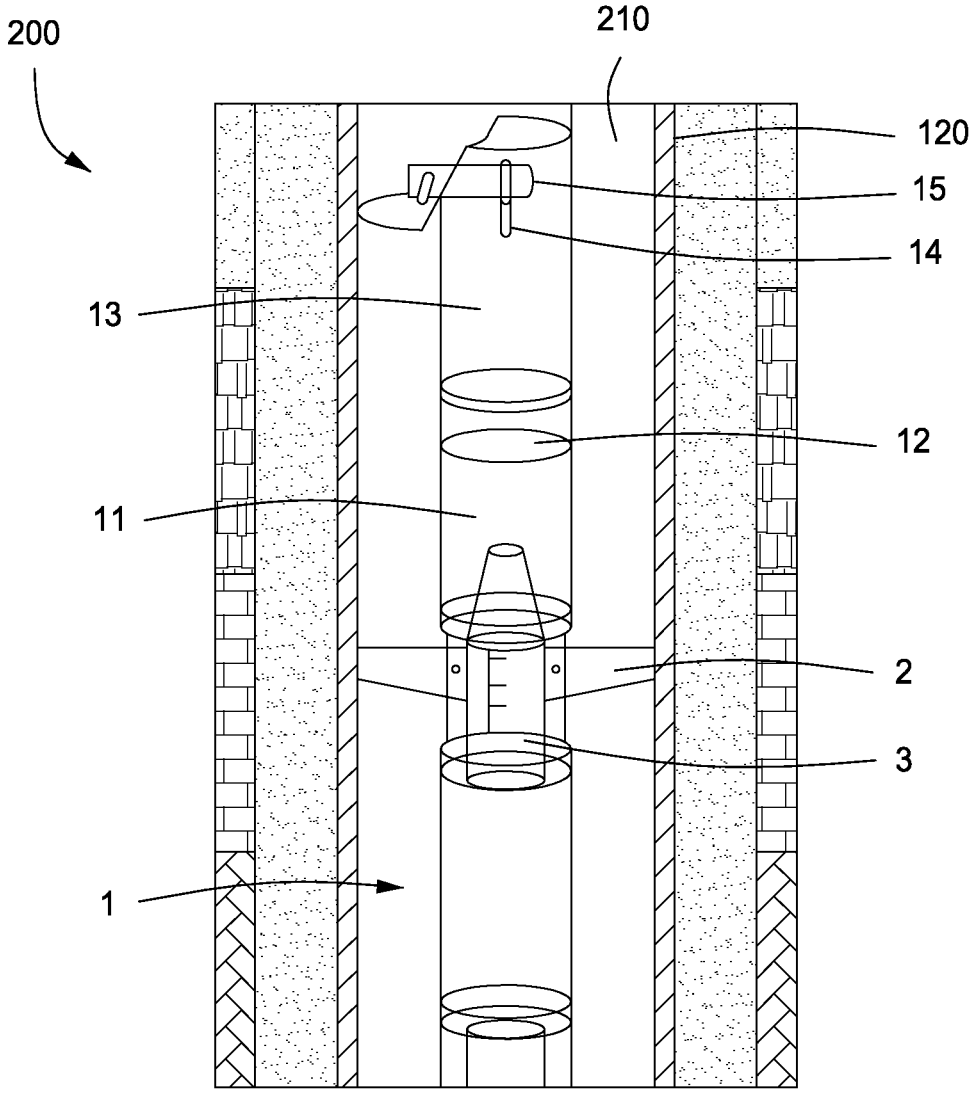

FIGS. 4A through 4C illustrate the downhole hydraulic jetting assembly 200 of the present invention, in other views. The jetting assembly 200 is again shown within a wellbore 210 that has been completed through multiple geologic formations.

FIG. 4A presents a perspective view of the downhole jetting assembly 200 in its run-in position. Here, the assembly 200 is descending down the string of production tubing 130. The production tubing 130 again represents a "slimhole" region within the production casing 120.

FIG. 4B is a cross-sectional view of the jetting assembly 200 of FIG. 4A. Here, the upper portion of the production casing 120 and the production tubing 130 have been removed for greater clarity. The production tubing 130 still resides concentrically within the production casing 120.

FIG. 4C is a cross-sectional view of the jetting assembly 200 of FIG. 4A. Here, the jetting assembly 200 has cleared the production tubing 130 and has been set within the string of production casing 120 adjacent a target producing formation 108. A jetting nozzle 230 has penetrated through a production casing exit 220 and an annular cement sheath 129, and is beginning to jet a lateral borehole 225 into the formation.

The assembly 200 will now be discussed below with respect to FIGS. 3A through 3D, and FIGS. 4A through 4C, together.

Examining the assembly 200 from the bottom-up, the assembly 200 first includes an anchor section 1. The anchor section 1 is for the purpose of setting the assembly 200 within a wellbore, and for resisting upward and downward forces during operation. The anchor section 1 defines a generally cylindrical body. Preferably, the anchor section 1 has a pointed lower tip 5 so as to permit ease of travel through tubulars, seating nipples, packers, and other downhole devices.

The assembly 200 also includes an orienting section 11. The orienting section 11 is connected to the anchor section 1, and serves as a register for the assembly 200. In this respect, the orienting section 11 allows the operator to manually adjust from the surface the radial direction in which the jetting hose 240 is urged into the formation 108.

Referring back to the anchor assembly 1, the anchor assembly 1 includes at least one set of slips 2. In the arrangement of FIG. 3A, the anchor section 1 includes both upper and lower rocker slips 2. Each illustrative slip 2 comprises four slip segments in approximately 90-degree orthogonal alignment. The slips 2 stabilize the assembly 200 via end teeth engaging the inner wall of the production casing 120.

Once the slips 2 have engaged the inner wall of the production casing 120, both the anchor section 1 and the connected orienting section 11 are affixed concentrically within the production casing 120. In another embodiment, the anchor section 1 may serve to fix the entire assembly 200 concentrically within the production casing 120. In the subject embodiment, the slip segments 2 have been forcibly translated from their original vertical ("running position"), recessed within the body of anchor section 1, to their now-horizontal alignment to engage the inner wall of the production casing 120. This forcible translation has, in the present embodiment, been accomplished by the displacement of upper and lower cones 3. The cones 3 are actuated, such as through hydraulic forces, to move in opposite directions. For example, the top cone may move upward, while the bottom cone moves downward within the body of the anchor section 1 to displace their respective (upper and lower) sets of slips 2. Conical faces of the cones 3 drive against tapered faces of the slips 2 as is known in the art of downhole setting tools.

Interestingly, by including a packing element(s) in the design of the anchor section 1, the assembly 200 may provide for zonal isolation of lateral boreholes from any open perforations or previously-generated lateral boreholes that may lie below the setting depth of the anchor section 1.

As noted, immediately above the anchor section 1 is the orienting section 11. The lower end of orienting section 11 is preferably rigidly affixed, or even integral with, the top of the cylindrical body defining the anchor section 1. The orienting section 11 itself comprises two cylindrical bodies 12, 13. The cylindrical bodies 12, 13 have mirrored sets of teethed grooves that can interlock to form a register. The bottom cylindrical body 12 is rigidly affixed within the lower portion of the orienting section 11. Hence, once the slips 2 of the anchor section 1 are actuated, the orienting section 11, too, is located and affixed concentrically within the wellbore's production casing 120.

In its set and operating position, the bottom cylindrical body 12 of the orienting section 11 is stationary relative to the production casing 120. However, the upper cylindrical body 13 of the orienting section 11 may rotate in relation to the bottom cylindrical body 12, and may also translate a few centimeters in the vertical relative to the bottom cylindrical body 12. The upper cylindrical body 13 has a bottom face of teethed groves that can interlock with those of the bottom cylindrical body 12. This may be achieved by pick-up or set-down forces from the high-pressure coiled tubing/jetting hose, such that when the apparatus experiences tensile forces, the mirrored teethed grooves of the upper cylindrical body 13 are disengaged from the grooves of the bottom cylindrical body 12. This allows the upper cylindrical body 13 to be rotated in relation to the bottom cylindrical body 12, such as by a 90-degree turn.

One radial translation method may be, for example, an incremental hydraulic pressure pulse (above that required to actuate the slips 2 of the anchor section 1) that causes the upper cylindrical body 13 to rotate relative to the bottom cylindrical body 12. This is done after the respective teethed grooves are disengaged using a pick-up force exerted on the coiled tubing attached to the assembly 200. A hydraulic indexing tool (not shown) may be provided for control of relative rotation between the upper 13 and bottom 12 cylindrical bodies. The indexing tool would be run between the end of a coiled tubing string and the assembly 200. Examples of a suitable indexing tool include Smith Services' 1.6875-inch OD "Hydraulic Indexing Tool," and Baker Hughes' 1.600-inch OD "Hydraulic Indexing Tool" (Product Family No. H13260). These products can provide rotation (perpendicular to the longitudinal axis of the wellbore) in precise 30-degree increments, with as little as 200 psi hydraulic actuating pressure.

Note that in highly directional and, particularly, horizontal wellbores, hydraulic actuation of downhole tools is often preferred over mechanical actuation. In this respect, it can be difficult to accurately and effectively translate tensile and rotational forces to the tools.

Preferably, the dimensions of the grooved teeth of the bottom 12 and upper 13 cylindrical bodies of the orienting section 11 provide incremental rotations for an indexing tool. For example, if an indexing tool with 30-degree incremental rotation is used for re-orientation, then the grooved teeth will be calibrated for either, 30-degree, or maybe 10-degree, rotational increments. Once the assembly 200 is re-oriented in a desired position, the bottom 12 and upper 13 cylindrical bodies are re-engaged. This may be done, for example with set-down force, or by releasing hydraulic force, thereby locking the orientation of the system in place within the production casing 120 of the wellbore 100. Such rotational and locking capability of the orienting section 11 allows for multiple casing exits 220 and horizontal lateral boreholes 225 at the same depth, without having to release and re-set the slips 2 of the anchor section 1.

The assembly 200 also includes a kick-over section 20. The kick-over section 20 defines a lower tubular body that is located above and is connected to the orienting section 11. Specifically, the kick-over section 20 may be hingedly or rigidly connected to the upper cylindrical body 13 of the orienting section 11. An example of a hinged connection is shown as bottom kick-over hinge 15.

The hinge 15 has pins on its bottom end that fully penetrate the upper cylindrical body 13 near its top, and that travels vertically within grooves 14 cut into the top of the upper cylindrical body 13. Hence, pick-up on the assembly 200 not only disengages the grooved teeth of bodies 12 and 13, but also allows for the rotation of the upper cylindrical body 13 and the kick-over section 20 in relation to the production casing 120.

The bottom kick-over hinge 15 is actuated through a downward force. When the bottom kick-over hinge 15 is actuated, it forces the bottom tubular body representing the kick-over section 20 toward an inner wall of the production casing 120. Beveled mating edges are provided between the kick-over section 20 and the orienting section 11. These beveled edges mate to constrain the downward movement of the kick-over section 20 in a plane parallel to the now-horizontal (when in set and operating position) axis of the bottom kick-over hinge 15.

The kick-over section 20 defines an elongated body. The kick-over section 20 includes a portal at the top dimensioned to receive the jetting hose 240. In one aspect, the portal defines a circular enclosure for receiving a jetting nozzle 230 and attached hose 240. Alternatively, the portal may be only partially enclosed for better displacement of jetted debris and "cuttings". In either arrangement, the portal assists in directing the jetting nozzle 230 to the desired point of casing exit 220.

Figure 7A:
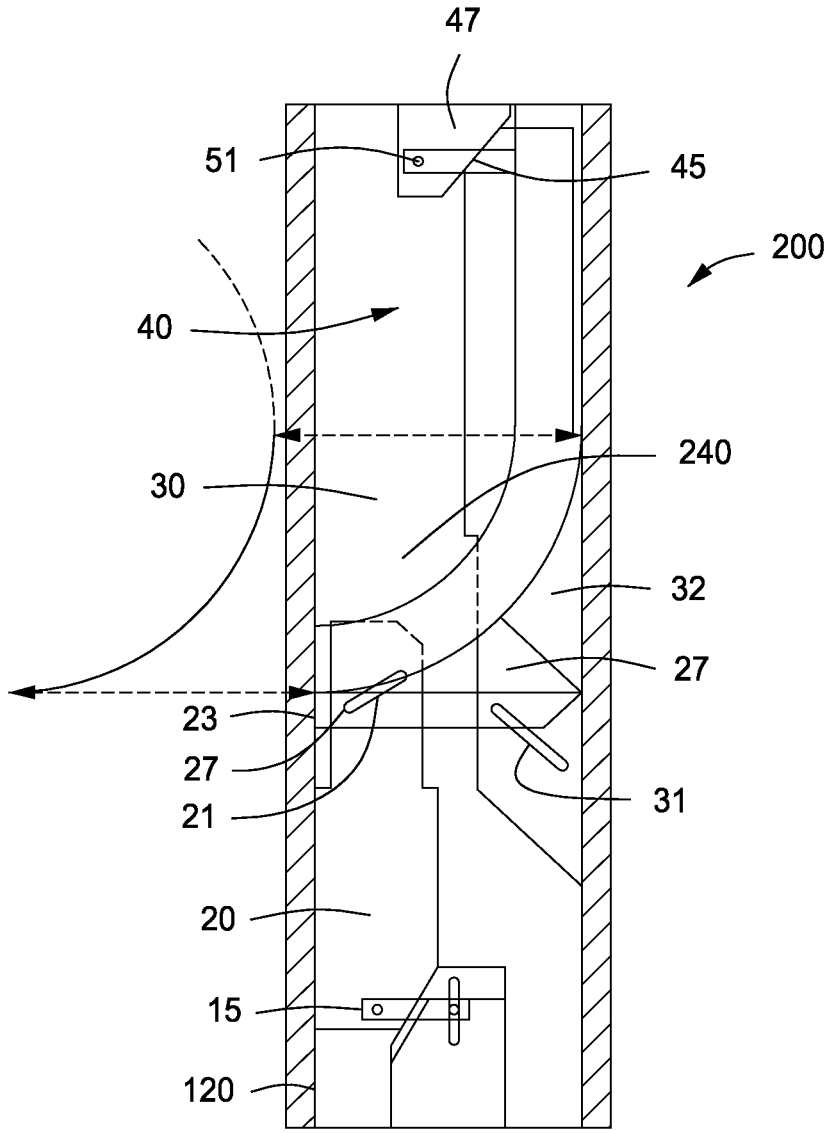
FIGS. 7A through 7C present another series of an enlarged portion of the downhole hydraulic jetting assembly of FIGS. 3A through 3D. In these views, the hose bending section of the jetting assembly is seen within a wellbore.
Figure 7B:
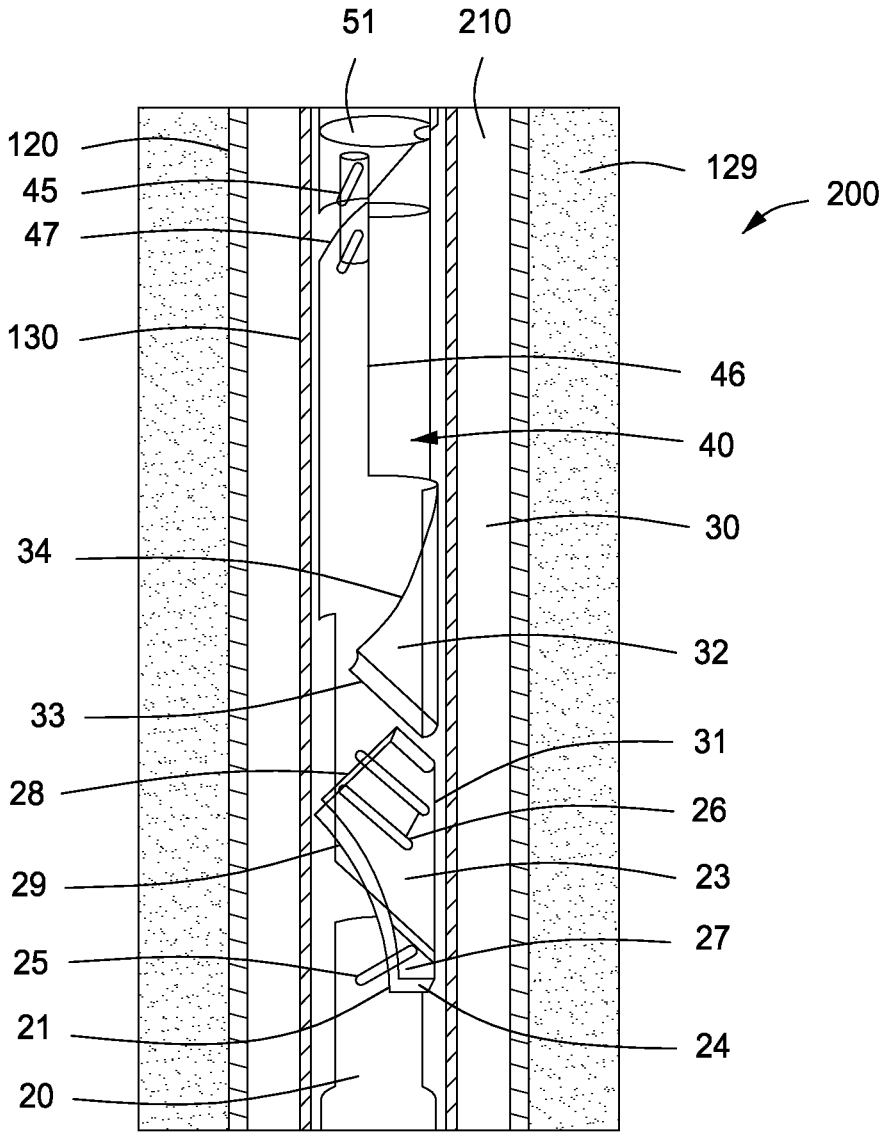
Figure 7C:
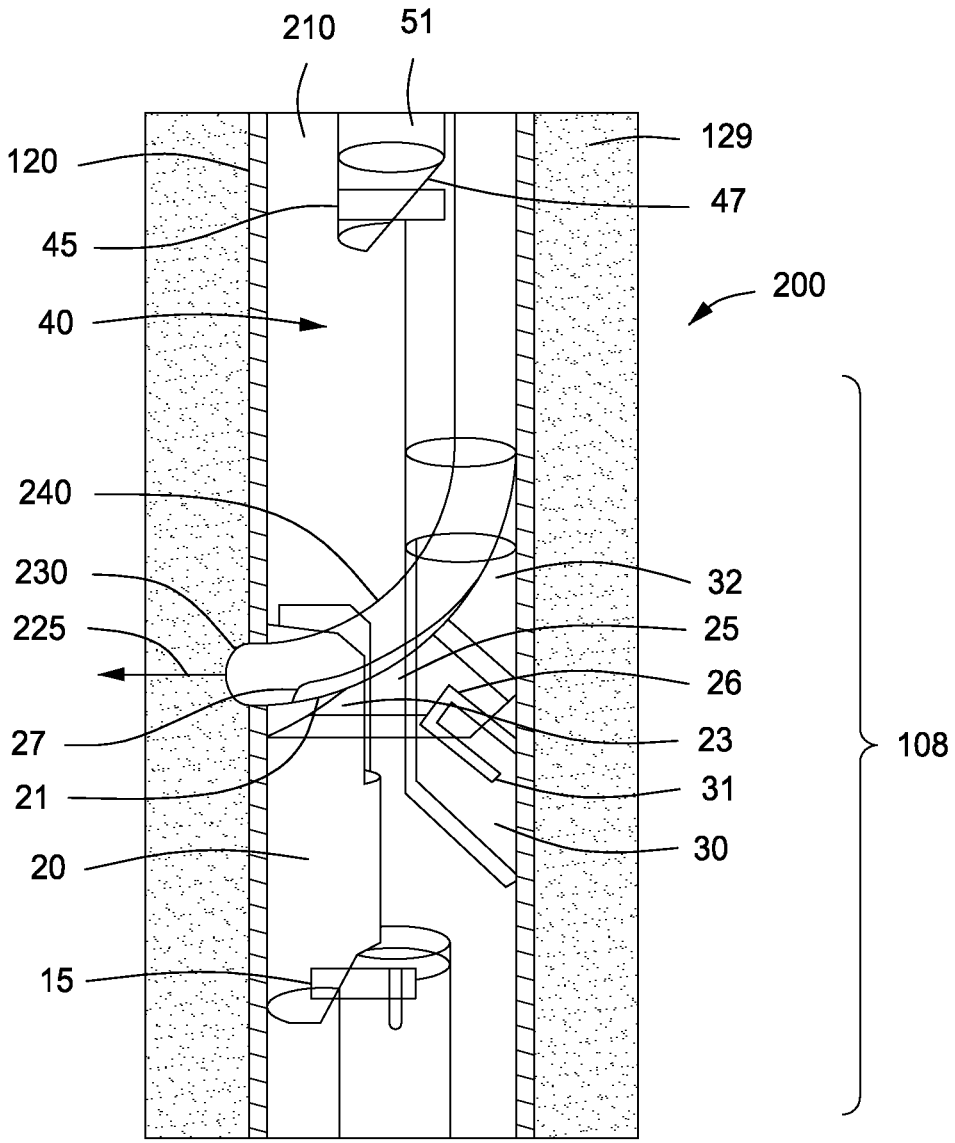

The kick-over section 20 is connected to the next sequential section of the assembly 200, which is a hose-bending section 30. This connection is by virtue of a kick-over guide hinge 25. FIGS. 7A through 7C present another series of an enlarged portion of the downhole hydraulic jetting assembly 200 of FIGS. 3A through 3D. In these views, the hose-bending section 30 of the jetting assembly 200 is seen within a wellbore 210. Movement of the kick-over guide hinge 25 is demonstrated.

FIG. 7A is a side view of the hose-bending section 30 of the jetting assembly 200. Here, the hose-bending section 30 is set and is in its operating position. The hose-bending section 30 is within a production casing 120, shown schematically.

FIG. 7B is a perspective view of the hose-bending section 30 of the jetting assembly 200. Here, the hose-bending section 30 is in its run-in position, and is being moved through a string of production tubing 130. The production tubing 130 resides concentrically within the production casing 120.

FIG. 7C is another perspective view of the hose-bending section 30 of the jetting assembly 200. The hose-bending section 30 has cleared the production tubing (not shown), and is now receiving a jetting hose 240. The jetting hose 240 has created an opening 220 in the production casing 120, and is moving into the formation 108 to form a borehole 225, or mini-lateral.

Referring to FIGS. 7A through 7C together, the hose-bending section 30 comprises two pieces: a bottom whipstock member 23, and a top whipstock member 32. The bottom whipstock member 23 has an arc face 29; similarly, the top whipstock member 32 has an arc face 34. In the run-in position for the jetting assembly shown in FIG. 7B, the two arc faces 29, 34 are independent; however, in the set position shown in FIG. 7C, the two arc faces 29, 34 are abutted to form a single whipstock face.

It is noted that the bottom whipstock member 23, and a top whipstock member 32 may, in an alternate embodiment, be combined so as to form a single whipstock member. In this embodiment, a single pin such as kick-over hinge 15 connects the kick-over section 20 to the whipstock as the hose-bending section 30. The single whipstock member is rotated into a position to receive an advancing jetting hose, and conforms the jetting hose to an approximate 90-degree bend. The bend again will have a radius equivalent to the inner diameter of the production casing. When in a retracted position, the single whipstock member conforms to the outer diameter of the body of the hose-bending section 30, thereby providing for passage through a slimhole region.

The kick-over guide hinge 25 assists in moving the hose-bending section 30 from its run-in position (FIG. 7B) to its set position (FIG. 7C). Like the bottom kick-over hinge 15, the kick-over guide hinge 25 partially rotates in a single plane only. The plane of rotation is parallel to the longitudinal axis of the wellbore 210. Note also that both of the hinges 15 and 25 (as well as top kick-over hinge 45 discussed below) rotate in the same vertical plane.

Slots 21 and 31 are provided in the bodies of the kick-over section 20 and the hose bending section 30, respectively. These slots 21, 31 provide paths by which a first pin 26 and a second pin 27 will travel. Each slot 21, 31, and each pin 26, 27, reside in a bottom whipstock member 23 of the hose-bending section 30. As the pins 26, 27 move through the respective slots 21, 31, the bottom whipstock member 23 rotates from a run-in position (see FIG. 7B) to a set position (FIG. 7C).

In FIG. 7B, the first pin 26 is seen as a top pin, while the second pin 27 is seen as a bottom pin. This is in the assembly's run-in position. In FIG. 7C, the first pin 26 translates into a right pin 26, while the second pin 27 translates into a left pin 27. This is in the set and operating position. In a vertical wellbore, the first pin 26 traverses along path 31; at the same time, the second pin 27 traverses along path 21 (see FIG. 7A).

The bottom whipstock member 23 has an upper face that is beveled. The beveled upper face is seen at 28 in FIG. 7B. As noted, in this view the hose-bending section 30 is in its run-in position. Likewise, the top whipstock member 32 has a lower face that is beveled. The beveled lower face is seen at 33. As the hose-bending section 30 is rotated from its run-in position into its set and operating position, the upper face 28 of the bottom whipstock member 23 will be rotated to abut the lower face 33 of the top whipstock member 32.

It is noted that the bottom whipstock member 23 also has a lower face 24. The lower face 24 preferably has teeth to stabilize its engagement to the inner face of the production casing 120 upon its rotation into the set and operating position (seen in FIG. 7C).

As suggested from its name, the hose-bending section 30 serves to receive the jetting hose 240, and bend it 90 degrees. To accomplish this bending function, the hose-bending section 30 has a whipstock face. The whipstock face comprises a combination of the two arced surfaces—the arc face 34 along the top whipstock member 32, and the arc face 29 along the bottom whipstock member 23. The whipstock face is formed when the bottom whipstock member 23 rotates into its set position, causing the two arc faces 29, 34 to meet. Upon meeting, the two arc faces 29, 34 span substantially the entire inner diameter of the production casing 120 (shown best in FIGS. 7A and 7C).

When the two arc faces 29, 34 meet, they form a bend radius for the hose-bending section 30. The bend radius is demonstrated in FIG. 7A. The bend radius allows the jetting hose 240 to be turned along the full I.D. of the production casing 120. At the same time, the assembly 200 is configured to allow the assembly 200 to be delivered through production tubing 130 or other slimhole area having a much smaller I.D. that the production casing 120.

It is preferred that the two arc faces 29, 34 be concave in nature. This helps to cradle and stabilize the jetting hose 240 as it passes along the top whipstock member 32 and the bottom whipstock member 23. In one embodiment, the two components 32, 23 would either form partially or fully enclosed matching arc tunnels. This would further assist in guiding the jetting hose 240 to a precise point of casing exit 220.

The jetting assembly 200 includes yet another section, which is the hose-straightening section 40. The hose-straightening section 40 defines an upper tubular body that is affixed atop the hose-bending section 30. In its set and operating position, the hose-straightening section 40 urges the hose 240 toward the top of the arc face 34 for the top whipstock member 32.

The hose-straightening section 40 is seen in FIGS. 7A through 7C. The hose-straightening section 40 is also seen in FIGS. 3A and 3C. It can be seen that the hose-straightening section 40 defines an elongated body dimensioned to be received within a string of production tubing 130. The hose-straightening section 40 includes an upper beveled face 47 that faces toward the wall of the casing 120 where the casing exit 220 is (or will be).

Internal to the hose straightening section 40 is a cylindrically-shaped channel 46. This is seen best in FIG. 7B. The channel 46 is a cylindrical opening that passes through the longitudinal axis of the tubular body making up the hose-straightening section 40. Preferably, the channel 46 has a larger diameter at the top, and gradually tapers to a smaller diameter toward the bottom.

The function of the channel 46 is to receive the jetting nozzle 230 and jetting hose 240 from above, and then guide it toward the arc face 34 of the top whipstock member 32. As the jetting hose 240 passes through the channel 46, it contacts the arc face 34 and begins to bend along bend radius 35. At the same time, the jetting hose 240 contacts and is stabilized along the inner wall of the casing 120 opposite the side of casing exit 220. Accordingly, when the jetting nozzle 230 (or a bit/mill assembly) is engaged in eroding or drilling the casing exit 220, and subsequently while the jetting nozzle 240 is eroding the lateral borehole 225 within the formation 108 itself via continuous feeding of the jetting hose 240, the bend radius 35 of the jetting hose 240 is always utilizing the full ID of the production casing 120. This will provide for maximum ID in the selection of a jetting hose 240, and maximum hydraulic horsepower at the jetting nozzle 230.

Another benefit of the hose-straightening section 40 is that backwards thrust forces from the jetting nozzle 230 are largely distributed to the wall of the production casing 120. The hose-straightening section 40 and the wall of the casing 120 are then together able to stabilize the hose 240 during fluid injection.

Yet another section of the assembly 200 is a hose-guiding section 50. The hose-guiding section 50 is connected to the top of the hose-straightening section 40. The hose-guiding section 50 is the uppermost member of the assembly 200, and is the first component to receive the jetting hose 240 downhole.

The hose guiding section 50 is connected to the hose-straightening section 40 by a top kick-over hinge 45. In the assembly's set and operating position, the top kick-over hinge 45 is of such a length as to locate the hose-guiding section 50 concentrically at-or-near the center longitudinal axis of the production casing 120.

FIGS. 8A through 8D present another series of an enlarged portion of the downhole hydraulic jetting assembly of FIGS. 3A through 3D. In these views, the hose-guiding section 50 of the jetting assembly 200 is seen within a wellbore 210.

Figure 8A:
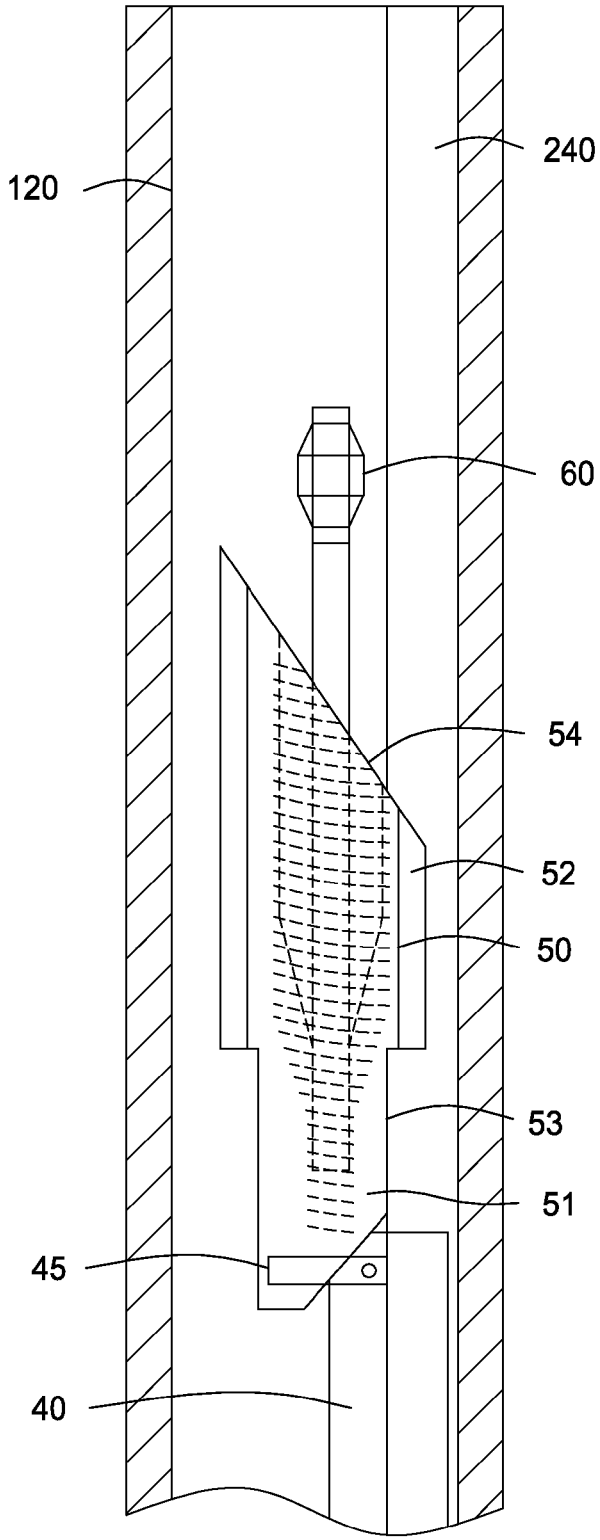
FIGS. 8A through 8D present another series of an enlarged portion of the downhole hydraulic jetting assembly of FIGS. 3A through 3D. In these views, the hose guiding section of the jetting assembly is seen within a wellbore.

FIG. 8A is a side view of the hose guiding section 50 of the jetting assembly 200. Here, the hose-guiding section 50 is set and is in its operating position. The hose-guiding section 50 is within the production casing 120, shown schematically.

Figure 8B:
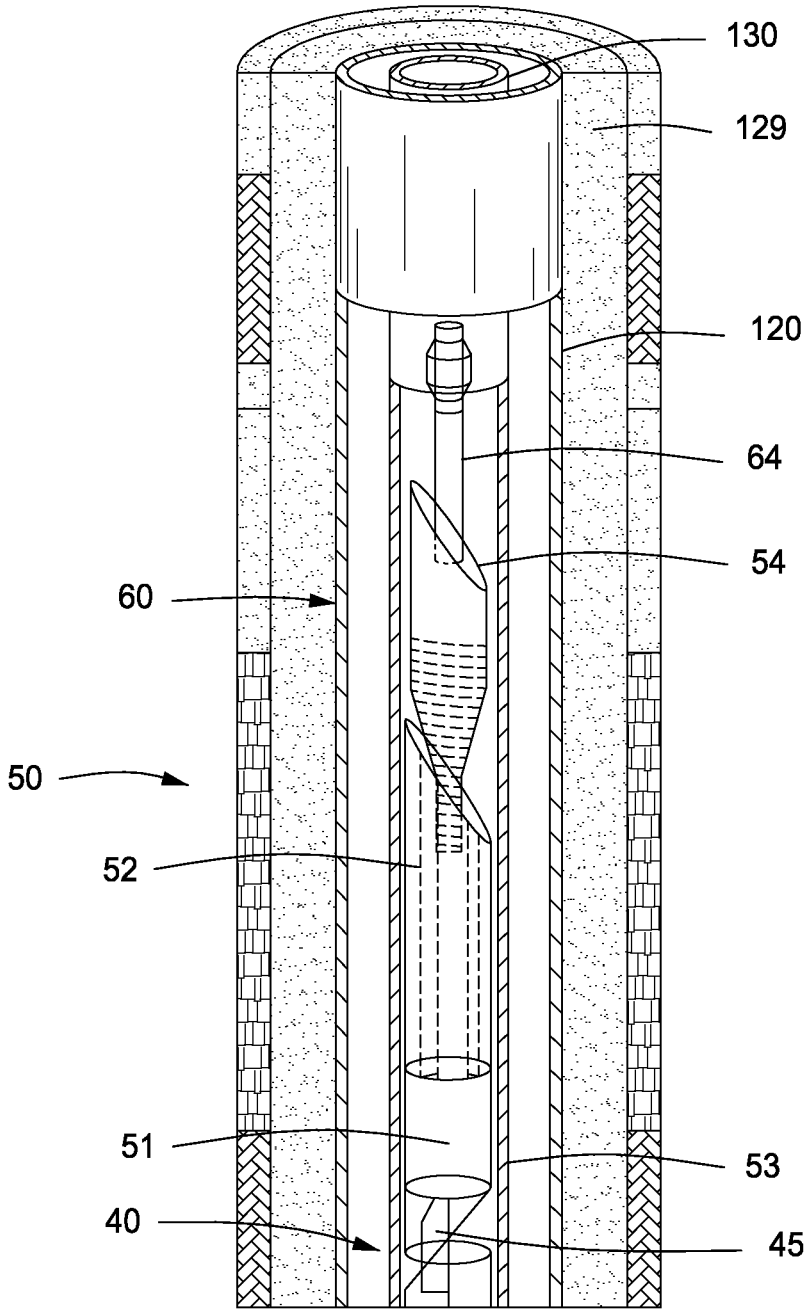

FIG. 8B is a perspective view of the hose-guiding section 50 of the jetting assembly 200. Here, the hose-guiding section 50 is in its run-in position, and is being moved through the string of production tubing 130. The production tubing 130 resides concentrically within the string of production casing 120.

Figure 8C:
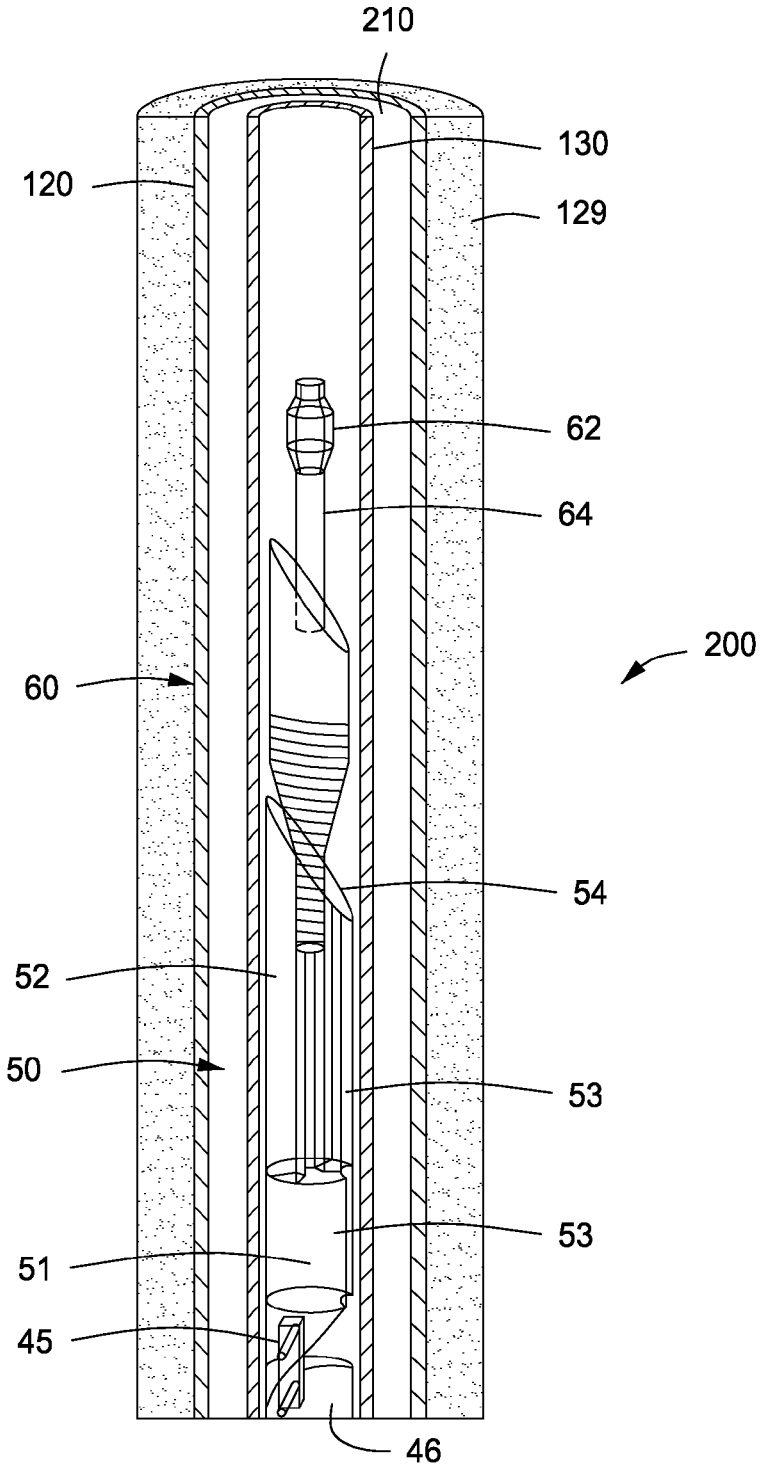

FIG. 8C is a cross-sectional view of the hose-guiding section 50 of FIG. 8A. Portions of the production casing 120 and production tubing 130 are removed for clarity.

Figure 8D:
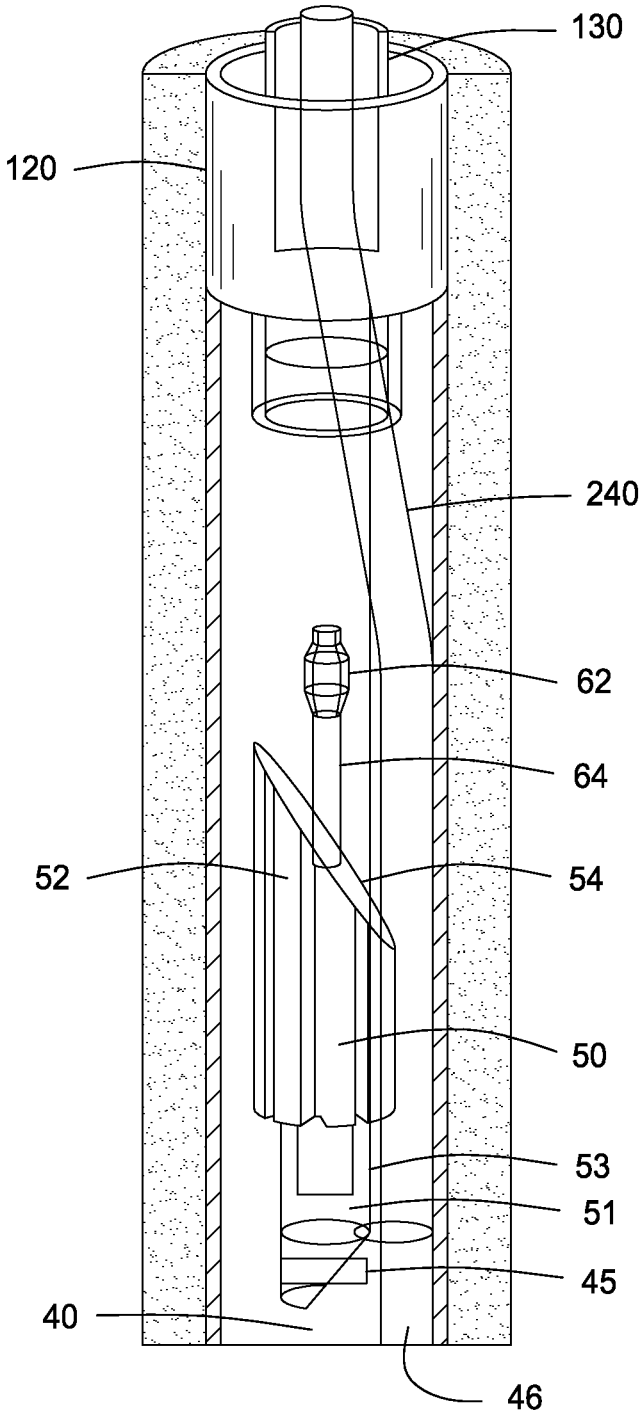

FIG. 8D is another perspective view of the hose-guiding section 50 of the jetting assembly 200. The hose-guiding section 50 has cleared the production tubing 130, and is now receiving a jetting hose 240. The hose-guiding section 50 is in operating position.

FIGS. 8A through 8D are discussed together to demonstrate features and operation of the hose-guiding section 50.

The hose-guiding section 50 consists of two portions—a lower portion 51 and an upper portion 52. The lower portion 51 defines a substantially rigid body, with a concave outer face 53. The outer face 53 serves as a channel for receiving and directing the jetting nozzle 230 and jetting hose 240, and guiding them downward along the production casing wall 120. In one aspect, bearings or rollers are provided along the outer face 53 to reduce friction along the outer wall of the jetting hose 240. The outer face 53 aligns the jetting nozzle 230 for receipt by the hose-straightening section 40. The outer face 53 then directs the jetting nozzle 230 and hose 240 into the channel 46 within the hose-straightening section 40.

The upper portion 52 of the hose-guiding section 50 represents an elongated tubular body. The upper portion 52 has a top face 54 that is beveled toward the inner face of the production casing 120, opposite the point of desired casing exit. The upper portion 52 of the hose-guiding section 50 is preferably expandable. In one embodiment, the expansion of the upper section 52 is accomplished by driving segments A, B, C, D, E, F, and G (seen in FIG. 3B) radially outward. Segment expansion may be accomplished using a tapered, conical, threaded fishing neck 60, as shown best in FIG. 8C. The fishing neck will have a male coupling 62 and shaft 64 at the top for transmitting torque. By rotating the fishing neck 60, the fishing neck 60 will advance into the upper portion 52 of the hose-guiding section 50. The segments A through G are then displaced radially outward, much like that of a toggle bolt.

Rotational force on the fishing neck 60 causes the segments of the upper portion of the hose-guiding section 50 to expand radially outwards, thereby preventing the hose from bypassing the face 54 and the channel 46 when the assembly 200 is being set and operated in the production casing 120. Conversely, reverse rotational force exerted on the fishing neck 60 causes the segments of the upper portion of the hose-guiding section 50 to retract radially inwards, thereby conforming their outer perimeters to the outer diameter of the body of the hose-guiding section 50, thereby allowing the hose-guiding section 50 to pass through a slimhole region.

In another, and more preferred embodiment, radial expansion of the upper portion 52 may be accomplished using a dovetailed tongue-and-groove system, in which the conical fishing neck 60 has vertically oriented tongues. Each tongue (not shown) will correspond to each of the dovetail grooves cut within each segment A through G of the upper portion 52 of the hose-guiding section 50. In this manner, the operator would not need a running/setting tool that could rotate, as the segments A through G would be able to be expanded and retracted with simple downwards compressive (set down) force, and simple tensile upwards pull, respectively, or alternatively set with incremental hydraulic force.

A "gap" is provided in the upper portion 52 of the hose-guiding section 50. The gap resides between segments A and G. The gap is large enough to receive the nozzle 230 and connected jetting hose 240. In one aspect, the jetting nozzle 230 has an O.D. of 0.90-inches.

In another embodiment, the upper portion of the hose-guiding section does not have expanding/retracting body segments, but instead uses a series of descending deflection shields (not shown) around an outer diameter of the hose-guiding section 50. The deflection shields are raised and lowered on pivot arms placed circumferentially around the hose-guiding section 50. When in their raised position within the production casing, the deflection shields leave but one path for an advancing jetting hose to follow, such that the jetting nozzle (or milling assembly and mill) and jetting hose are guided into the curved face of the whipstock member(s). When in retracted position, the outer perimeters of the deflection shields conform to the outer diameter of the body of the hose-guiding section 50, allowing the hose-guiding section 50 to pass through a slimhole region.

In operation, when the jetting hose 240 is run into the wellbore 210, the upper portion 52 of the hose-guiding section 50 will be the first portion of the assembly 200 to be contacted by the jetting nozzle 230. The upper beveled face 54 deflects the jetting nozzle 230, guides the jetting nozzle 230 and connected hose 240 into the channel 53 and then the channel 46. This is done after the upper portion 52 of the hose-guiding section 50 has been expanded. The expansion capacity of the upper portion 52 must be sufficient to allow entry of the jetting nozzle 230 entry only into the designed hose-path. In any event the upper portion 52 and the lower portion 51 together serve as a hose-guiding member.

The nozzle 230 and hose 240 are directed parallel to the longitudinal axis of the wellbore 210, constrained by the two adjoining expansion segments A and G. Segments A and G reside in the upper portion 52 of the hose-guiding section 50. The nozzle 230 and hose 240 are further guided by the body of the fishing neck 60 and the casing 120 wall itself. From there, the nozzle 230 and hose 240 are guided through the channel 53 of the lower portion 51 of the hose-guiding section 50. This aligns the nozzle 230 and hose 240 with the concave channel 46 of the upper portion of the hose-straightening section 40. This is seen at FIG. 8D.

The nozzle 230 and hose 240 next encounter the hose-bending section 30. At this point, the nozzle 230 will contact the arc face 34 of the top whipstock member 32, and then the arc face 29 along the bottom whipstock member 23. From this point, the hose 240 is fed such that the nozzle 230 and hose 240 proceed along the concave path of the top whipstock member 32 and the bottom whipstock member 23, until the nozzle 230 is turned approximately 90 degrees. Ultimately, the nozzle 230 will be directed substantially perpendicular to the longitudinal axis of the production casing 120.

In one embodiment of the assembly 200, the components, including the slips 2 of anchor section 1, the bottom kick-over hinge 15, the kick-over guide hinge 25, the top kick-over hinge 45, and the fishing neck 60, may be designed such that they are set sequentially by incremental hydraulic pressures. For example, the slips 2 may be designed to deploy at 200 psi; the bottom kick-over hinge 15 may be designed to actuate at 300 psi; the kick-over guide hinge 25 may deploy at 400 psi; the top kick-over hinge 45 may be designed to actuate at 500 psi; and finally the fishing neck 60 at 600 psi. In such an arrangement, the design could incorporate release of the hinges 15, 25, and 45 with a certain amount of over-pull, but such that the slips 2 of the anchor section 1 remained engaged, thereby providing for re-orientation of the assembly 200, then re-actuation of the hinges 15, 25, and 45, for boring a subsequent lateral borehole at the same depth.

Use of the assembly 200 beneficially allows the operator to continue production of a flowing well during the process of jetting a lateral borehole 225. If no significant increase in oil and/or gas production rate is observed in connection with fluid returns, the operator may choose to cease jetting that specific mini-lateral. The operator can then index the assembly 200 to another radial direction, and form a new mini-lateral. Alternatively, the operator may release the slips 2 in the anchor section 1, and move the assembly 200 to a slightly different depth and, optionally, different orientation, before beginning a new jetting procedure. Conversely, if favorable production increase is observed, the operator may attempt to maximize the length and/or diameter of that specific mini-lateral borehole. Hence, "real time" production and pressure responses are realized in jetting mini-laterals using the assembly 200 herein.

As can be seen, improved methods for forming lateral wellbores from a parent wellbore are provided. Improved systems for forming lateral boreholes are also provided. The systems and methods allow for delivery and setting of a hydraulic jetting assembly through a slimhole region in a wellbore using coiled tubing. It is no longer required to kill the well or to remove the wellhead and install BOP equipment above the casing. (Of course, well control equipment will be provided with the coiled tubing set-up.) Further, it is no longer required to pull the production tubing, nor are there concerns of retrieving a stuck packer or tubing anchor.

The method provides for running a jetting hose through a first window by turning the jetting hose across a bend radius equivalent to the full inner diameter of the production casing. Then, using hydraulic fluid, jetting a lateral borehole into the subsurface formation. In one embodiment, the borehole is jetted at a depth of greater than 400 feet, and to a length of at least 50 feet (15.2 meters) from the wellbore.

A conventional fluid nozzle may be used for jetting mini-laterals. Preferably, however, the jetting nozzle 230 defines a hydraulic nozzle equipped with inner baffles and/or bearings that interface with ports or slots in the nozzle 230. As fluid is pumped through the hose 240, the baffles or bearings rotate along a longitudinal axis of the jetting hose 240. In one aspect, the ports reside at the leading edge of the nozzle 230 so that maximum fluid is directed against the formation being cut. The ports may be disposed radially around the leading edge of the nozzle 230 to facilitate cutting a radial borehole.

In another embodiment, a hydraulic collar or seat is placed in the jetting hose 240 proximate the nozzle 230. In addition, rearward-directed ports may be placed proximate the collar or along the jetting hose 240 just a few inches to a few feet up-string of the jetting nozzle 230. In operation, the operator may pump a small ball down the jetting hose 240. The ball will land on the collar, which in turn will open the reward-directed ports. This provides for expulsion of some fraction of the jetting fluid in a rearward direction, thereby providing thrust to advance the jetting nozzle 230 forward into the newly generated lateral borehole while helping to enlarge the borehole and to keep it clear of cuttings. This may allow the jetting hose to penetrate a distance even greater than 500 feet from the parent wellbore.

Given the subject method and invention, no cement squeezes are required to remediate wells in these situations. A slimhole recompletion, where the casing leaks are isolated by running a packer on the end of the production tubing; and/or cementing the production tubing in place inside the well's production casing, can immediately isolate the producing formation from the casing leak. Any drilling mud left in the wellbore opposite the producing formation can then be jetted out with the same coiled tubing unit that will subsequently perform the lateral jetting operations. The hydraulically jetted horizontal laterals will then be able to access "fresh rock", well beyond the mud-damaged interface of the original hydraulic fracture plane.

Optionally, the casing exit may be accomplished utilizing a small mill and milling assembly placed at the end of the jetting hose in lieu of a simple nozzle. The mill can cut through the production casing to form a window. Thereafter, the mill and milling assembly are removed and replaced with a jetting nozzle. The jetting nozzle is run down to the hose-bending section and to the newly-milled window to jet a lateral borehole. This process of milling and jetting may be repeated at different radial orientations in order to create a plurality of "mini-laterals" at selected depths.

In addition to these benefits, the systems and methods allow the operator to maximize power output, as a larger jetting hose may be deployed as compared to the hose size that the operator could use with previously known systems and methods.

While it will be apparent that the inventions herein described are well calculated to achieve the benefits and advantages set forth above, it will be appreciated that the inventions are susceptible to modification, variation and change without departing from the spirit thereof. While it is realized that certain embodiments of the invention have been disclosed herein, it is perceived that further modifications will occur to those skilled in the art, and such obvious modifications are intended to be within the scope and spirit of the present invention.

What is claimed is:

1. A downhole tool assembly for forming a lateral borehole within a subsurface formation from an existing wellbore using hydraulic forces that are directed through a jetting hose, the wellbore having been completed with a string of production casing defining an inner diameter, and the tool assembly comprising:

a hose-bending section comprising a whipstock member having a curved face, with the curved face defining a bend radius for the jetting hose;

a pin, wherein:

the whipstock member is configured to rotate about the pin from a first run-in position, to a second set position in response to a force applied to the tool assembly, and in the set position, the whipstock member is configured to receive the jetting hose and to direct the letting hose across the entire inner diameter of the production casing to a window location in the production casing; and a hose guiding section comprising:

a deflecting body having an upper end and a lower end, wherein the upper end of the deflecting body has a beveled surface defining a face for deflecting the jetting hose within the wellbore;

a longitudinal channel along an outer diameter of the deflecting body for receiving and guiding the jetting hose to the whipstock member at a point adjacent the production casing opposite the window; and a fishing neck, wherein the fishing neck has an upper end dimensioned to be connected to a run-in tool, and a lower end dimensioned to be received within the upper end of the deflecting body of the hose-guiding section.

2. The tool assembly of claim 1, wherein:

the tool assembly is configured and dimensioned to pass through a slim hole region in the wellbore when the whipstock member is in the run-in position, the slim hole region defining an inner diameter that is less than the inner diameter of the production casing.

3. The tool assembly of claim 2, wherein the slim hole region defines (i) a straddle packer, (ii) a production tubing, (iii) a repair casing, or (iv) combinations thereof.

4. The tool assembly of claim 3, further comprising:

an orienting member; and wherein the whipstock member is operatively and pivotally connected to the orienting member to rotationally adjust the angular orientation of the bend radius within the production casing.

5. The tool assembly of claim 4, further comprising:

an anchor settable within the wellbore; and wherein:

(i) the orienting member is connected to the anchor, or (ii) the orienting member is configured to land on the anchor in the wellbore below the slim hole region when the anchor is set;

the anchor comprises slips for releasably engaging the surrounding production casing; and the orienting member is configured to adjust the angular orientation of the bend radius while the slips engage the surrounding production casing.

6. The tool assembly of claim 3, wherein the upper end of the deflecting body of the hose-guiding member is expandable.

7. The tool assembly of claim 6, wherein:

the lower end of the fishing neck is conically tapered downwards, and comprises threads; and rotation of the fishing neck causes the deflecting body of the hose-guiding section to expand to direct the jetting hose towards the longitudinal channel when the tool assembly is being set and operated in production casing.

8. The tool assembly of claim 3, wherein the hose-guiding section comprises a series of descending deflection faces that translate from a first run-in position that permits the tool assembly to pass through the slim hole region, to a second set position in response to the compressive forces, wherein the deflection faces extend from the tool assembly towards the production casing in the set position to direct the jetting hose towards an upper end of the whipstock member.

9. The tool assembly of claim 2, wherein the whipstock member is a single body having an integral curved face configured to receive the jetting hose and redirect the hose about 90 degrees within the inner diameter of the production casing.

10. The tool assembly of claim 2, wherein the whipstock member comprises:

a top whipstock member having a curved face, and an abutting face; and a separate bottom whipstock member also having a curved face, and an abutting face, the curved face of the bottom whipstock member having a radius that is substantially the same as a radius of the curved face of the top whipstock member;

wherein:

the bottom whipstock member is rotatable within the wellbore independent of the top whipstock member in response to a compressive force on the tool assembly from a first run-in position, to a second set position; and when the bottom whipstock member is rotated to its set position, the abutting face of the bottom whipstock member abuts with the abutting face of the top whipstock member so that the curved face of the top whipstock member and the curved face of the bottom whipstock member meet to form a unified bend radius across the entire inner diameter of the production casing.

11. The tool assembly of claim 10, wherein:

the bottom whipstock member is dimensioned so that, in its run-in position, the bottom whipstock member may pass through the, slim hole region within the wellbore; and the bottom whipstock member rotates to its set position after passing through the slim hole region when the system is anchored in the wellbore.

12. The tool assembly of claim 11, further comprising:

a kick-over member below the bottom whipstock member, the kick-over member having an upper end and a lower end; and a bottom kick-over hinge, the bottom kick-over hinge being pivotally connected to the lower end of the bottom kick-over member to allow the bottom kick-over member to translate from a first position aligned with a major axis of the bottom whipstock member in its run-in position, to a second position against an inner wall of the production casing in response to the compressive force.

13. The tool assembly of claim 12, wherein the kick-over member defines a tubular body having an inner diameter and an outer diameter.

14. The tool assembly of claim 13, wherein:

the outer diameter of the bottom tubular body is dimensioned to pass through the slim hole region; and the bottom whipstock member is pivotally connected to the upper end of the bottom tubular body.

15. The tool assembly of claim 14, wherein the tubular body comprises an opening at the upper end for receiving the jetting hose from the bottom whipstock member and directing the jetting hose.

16. A method for forming lateral boreholes within a subsurface formation from an existing wellbore, the wellbore having been completed with a string of production casing defining an inner diameter, the method comprising:

providing a downhole tool assembly comprising:

a hose-bending section comprising a whipstock member having a curved face;

a pin, wherein:

the whipstock member is configured to rotate about the pin from a first run-in position, to a second set position, and the curved face defines a bend radius for a jetting hose that, in the set position, redirects the jetting hose across the entire inner diameter of the production casing to a window location in the production casing; and;

a hose-guiding section configured to direct the jetting hose to the whipstock at a point adjacent the production casing opposite the window;

running the tool assembly into the wellbore;

further running the tool assembly through a slim hole region within the wellbore while the tool assembly is in its run-in position, the slim hole region defining an inner diameter that is less than the inner diameter of the production casing;

further running the tool assembly beyond the slim hole region o a point in the wellbore adjacent the subsurface formation;

applying a force to the tool assembly to cause the whipstock member to rotate from its first run-in position to its second set position;

running the jetting hose into the wellbore and along the curved face within the production casing;

further running the jetting hose through a first window in the production casing; and further running the jetting hose into the wellbore while injecting hydraulic fluid through the hose under pressure to create a first lateral borehole in the subsurface formation.

17. The method of claim 16, wherein the first borehole extends from about 10 feet to 500 feet from the wellbore.

18. The method of claim 16, wherein the first borehole is formed at a wellbore depth greater than 400 feet.

19. The method of claim 16, wherein the whipstock member is a single body having an integral curved face configured to receive the jetting hose and redirect the hose about 90 degrees.

20. The method of claim 16, wherein the whipstock member comprises:

a top whipstock member having a curved face and an abutting face, and a bottom whipstock member also having a curved face and an abutting face, the curved face of the bottom whipstock member having a radius that is substantially the same as a radius of the curved face of the top whipstock member; and wherein applying a compressive force to the tool assembly causes (i) the bottom whipstock member to rotate from the first run-in position, to the second set position, and (ii) the abutting face of the top whipstock member to abut with the abutting face of the bottom whipstock member so that the curved face of the top whipstock member and the curved face of the bottom whipstock member meet to form a unified bend radius substantially across the inner diameter of the production casing.

21. The method of claim 20, wherein:

the curved face of the top whipstock member and the curved face of the bottom whipstock member together are configured to redirect the jetting hose about 90 degrees; and the bottom whipstock member substantially traverses across the inner diameter of the production casing when the bottom whipstock member is rotated into its set position.

22. The method of claim 16, wherein:

the wellbore is substantially horizontal at a depth of the subsurface formation; and the first lateral borehole extends substantially normal to the wellbore.

23. The method of claim 16, wherein:

the wellbore is substantially vertical at a depth of the subsurface formation; and the first lateral borehole extends substantially normal to the wellbore and along the plane of the subsurface formation.

24. The method of claim 16, further comprising:

using a milling assembly with a mill at an end, milling the first window in the production casing.

25. The method of claim 16, wherein:

the jetting hose is run into the wellbore after the tool assembly has been set; and the method further comprises using a hydraulic nozzle, jetting the first window with hydraulic fluid.

26. The method of claim 25, wherein the hydraulic fluid comprises water and a suspended abrasive material.

27. The method of claim 16, wherein the tool assembly further comprises an orienting member.

28. The method of claim 27, further comprising:

setting an anchor within the production casing of the wellbore below the slim hole region.

29. The method of claim 28, further comprising:

landing the orienting member onto the anchor after the anchor has been set.

30. The method of claim 28, wherein:

the orienting member is operatively connected to the anchor;

the whipstock member is operatively and pivotally connected to the orienting member; and the method further comprises changing the angular orientation of the whipstock member relative to the anchor.

31. The method of claim 28, further comprising:

discontinuing injecting hydraulic fluid through the jetting hose;

pulling the hose out of the first lateral borehole and the first window;

actuating the orienting member to rotate the whipstock member a selected number of degrees;

forming a second window in the production casing; and running the jetting hose into the wellbore and the second window while injecting hydraulic fluid through the hose under pressure to create a second lateral borehole in the subsurface formation.

32. The method of claim 28, further comprising:

producing formation fluids from the subsurface formation while injecting hydraulic fluid through the jetting hose.

33. The method of claim 27, wherein the hose-guiding section comprises a series of descending deflection faces that translate from a first run-in position that permits the tool assembly to pass through the slim hole region, to a second set position in response to the compressive forces, wherein the deflection faces extend from the tool assembly towards the production casing in the set position to direct the jetting hose towards an upper end of the whipstock member.

34. The method of claim 16, further comprising:

rotating the whipstock member within the production casing of the wellbore below the slim hole region.

35. The method of claim 16, wherein the hose-guiding section comprises:

a deflecting body having an outer diameter, an upper end and a lower end;

a beveled surface at the upper end of the deflecting body for deflecting the jetting hose within the wellbore; and a longitudinal channel along the deflecting body for receiving and guiding the jetting hose to the whipstock member.

36. The method of claim 35, wherein the hose-guiding section further comprises:

a lower tubular body having an elongated concave portion there along defining a channel for further receiving the jetting hose from the deflecting body and guiding the jetting hose to the whipstock member.

37. The method of claim 35, further comprising:

expanding the upper end of the deflecting body of the hose-guiding section after the device has passed through the slim hole region to prevent the jetting hose from bypassing the channel in the deflecting body when the jetting hose is run into the wellbore.

38. The method of claim , 35, wherein:

the device further comprises a fishing neck;

the fishing neck has an upper end dimensioned to be connected to a run-in tool, and a lower end dimensioned to be received within the deflecting body of the hose-guiding section; and expanding the upper end of the hose-guiding member comprises rotating the fishing neck.

* * * * *